US011806829B2

(12) United States Patent
Jawali et al.

(10) Patent No.: US 11,806,829 B2
(45) Date of Patent: Nov. 7, 2023

(54) ADVANCED POLISHING PADS AND RELATED POLISHING PAD MANUFACTURING METHODS

(71) Applicant: Applied Materials, Inc., Santa Clara, CA (US)

(72) Inventors: Puneet Narendra Jawali, San Jose, CA (US); Nandan Baradanahalli Kenchappa, San Jose, CA (US); Jason G. Fung, Santa Clara, CA (US); Shiyan Akalanka Jayanath Wewala Gonnagahadeniyage, Santa Clara, CA (US); Rajeev Bajaj, Fremont, CA (US); Adam Wade Manzonie, Santa Clara, CA (US); Andrew Scott Lawing, Newark, DE (US)

(73) Assignee: Applied Materials, Inc., Santa Clara, CA (US)

( * ) Notice: Subject to any disclaimer, the term of this patent is extended or adjusted under 35 U.S.C. 154(b) by 427 days.

(21) Appl. No.: 16/906,992

(22) Filed: Jun. 19, 2020

(65) Prior Publication Data

US 2021/0394333 A1 Dec. 23, 2021

(51) Int. Cl.
*B24B 37/24* (2012.01)
*B24B 37/22* (2012.01)
(Continued)

(52) U.S. Cl.
CPC ..... *B24B 37/24* (2013.01); *B24B 37/22* (2013.01); *B24B 37/26* (2013.01); *B24B 37/30* (2013.01)

(58) Field of Classification Search
CPC . B24D 3/18; B24D 3/32; B24D 11/04; B24D 11/00; B24B 37/20; B24B 37/22;
(Continued)

(56) References Cited

U.S. PATENT DOCUMENTS 2,001,911 A 5/1935 Wooddell et al.
3,357,598 A 12/1967 Kraft
(Continued)

FOREIGN PATENT DOCUMENTS

CN 1897226 A 1/2007
CN 101199994 A 6/2008
(Continued)

OTHER PUBLICATIONS

The Dow Chemical Company—"Specialty Elastomers for Automotive TPO Compounds" brochure, Nov. 2006, 8 pages.
(Continued)

*Primary Examiner* — Brian D Keller
*Assistant Examiner* — Steven Huang
(74) *Attorney, Agent, or Firm* — Patterson + Sheridan, LLP

(57) ABSTRACT

Embodiments herein generally relate to polishing pads and method of forming polishing pads. In one embodiment, a polishing pad having a polishing surface that is configured to polish a surface of a substrate is provided. The polishing pad includes a polishing layer. At least a portion of the polishing layer comprises a continuous phase of polishing material featuring a plurality of first regions having a first pore-feature density and a plurality of second regions having a second pore-feature density that is different from the first pore-feature density. The plurality of first regions are distributed in a pattern in an X-Y plane of the polishing pad in a side-by-side arrangement with the plurality of second regions and individual portions or ones of the plurality of first regions are interposed between individual portions or ones of the plurality of second regions.

15 Claims, 14 Drawing Sheets

(51) Int. Cl.
*B24B 37/26* (2012.01)
*B24B 37/30* (2012.01)

(58) Field of Classification Search
CPC ..... B24B 37/24; B24B 37/26; B24B 37/30; B24B 7/228
USPC ..... 451/527, 529, 41
See application file for complete search history.

(56) References Cited

U.S. PATENT DOCUMENTS 3,741,116 A 6/1973 Green et al.
4,459,779 A 7/1984 Shen
4,575,330 A 3/1986 Hull
4,836,832 A 6/1989 Tumey et al.
4,844,144 A 7/1989 Murphy et al.
4,942,001 A 7/1990 Murphy et al.
4,960,673 A 10/1990 Beck et al.
5,096,530 A 3/1992 Cohen
5,120,476 A 6/1992 Scholz
5,121,329 A 6/1992 Crump
5,178,646 A 1/1993 Barber, Jr. et al.
5,212,910 A 5/1993 Breivogel et al.
5,287,663 A 2/1994 Pierce et al.
5,300,417 A 4/1994 Lushington et al.
5,387,380 A 2/1995 Cima et al.
5,533,923 A 7/1996 Shamouilian et al.
5,605,760 A 2/1997 Roberts
5,609,517 A 3/1997 Lofaro
5,624,303 A 4/1997 Robinson
5,626,919 A 5/1997 Chapman et al.
5,645,471 A 7/1997 Strecker
5,738,574 A 4/1998 Tolles et al.
5,795,218 A 8/1998 Doan et al.
5,876,268 A 3/1999 Lamphere et al.
5,900,164 A 5/1999 Budinger et al.
5,905,099 A 5/1999 Everaerts et al.
5,906,863 A 5/1999 Lombardi et al.
5,921,855 A 7/1999 Osterheld et al.
5,932,040 A 8/1999 Audisio
5,932,290 A 8/1999 Lombardi et al.
5,940,674 A 8/1999 Sachs et al.
5,944,583 A 8/1999 Cruz et al.
5,965,460 A 10/1999 Rach et al.
5,976,000 A 11/1999 Hudson
5,984,769 A 11/1999 Bennett et al.
5,989,111 A 11/1999 Lamphere et al.
5,989,470 A 11/1999 Doan et al.
6,022,264 A 2/2000 Cook et al.
6,029,096 A 2/2000 Manners et al.
6,036,579 A 3/2000 Cook et al.
6,062,968 A 5/2000 Sevilla et al.
6,090,475 A 7/2000 Robinson et al.
6,095,902 A 8/2000 Reinhardt
6,117,000 A 9/2000 Anjur et al.
6,121,143 A 9/2000 Messner et al.
6,122,564 A 9/2000 Koch et al.
6,126,532 A 10/2000 Sevilla et al.
6,155,910 A 12/2000 Lamphere et al.
6,206,759 B1 3/2001 Agarwal et al.
6,210,254 B1 4/2001 Cook et al.
6,213,845 B1 4/2001 Elledge
6,228,133 B1 5/2001 Thurber et al.
6,231,942 B1 5/2001 Blizard et al.
6,241,596 B1 6/2001 Osterheld et al.
6,254,460 B1 7/2001 Walker et al.
6,257,973 B1 7/2001 Fernand Guiselin
6,273,806 B1 8/2001 Bennett et al.
6,309,282 B1 10/2001 Wright et al.
6,322,728 B1 11/2001 Brodkin et al.
6,328,634 B1 12/2001 Shen et al.
6,361,411 B1 3/2002 Chopra et al.
6,361,832 B1 3/2002 Agarwal et al.
6,390,890 B1 5/2002 Molnar
6,402,604 B2 6/2002 Guiselin
6,423,255 B1 7/2002 Hoechsmann et al.
6,428,586 B1 8/2002 Yancey
6,454,634 B1 9/2002 James et al.
6,477,926 B1 11/2002 Swisher et al.
6,488,570 B1 12/2002 James et al.
6,500,053 B2 12/2002 James et al.
6,520,834 B1 2/2003 Marshall
6,520,847 B2 2/2003 Osterheld et al.
6,544,373 B2 4/2003 Chen et al.
6,569,373 B2 5/2003 Napadensky
6,582,283 B2 6/2003 James et al.
6,585,563 B1 7/2003 Redeker et al.
6,592,443 B1 7/2003 Kramer et al.
6,641,463 B1 11/2003 Molnar
6,641,471 B1 11/2003 Pinheiro et al.
6,645,061 B1 11/2003 Bennett et al.
6,682,402 B1 1/2004 Roberts et al.
6,684,704 B1 2/2004 Obeng
6,699,115 B2 3/2004 Osterheld et al.
6,719,818 B1 4/2004 Birang et al.
6,736,709 B1 5/2004 James et al.
6,746,225 B1 6/2004 McHugh
6,749,485 B1 6/2004 James et al.
6,749,714 B1 6/2004 Ishikawa et al.
6,790,883 B2 9/2004 Ogawa et al.
6,796,880 B2 9/2004 Redeker et al.
6,811,680 B2 11/2004 Chen et al.
6,811,937 B2 11/2004 Lawton
6,833,046 B2 12/2004 Wright
6,840,843 B2 1/2005 Jones et al.
6,855,588 B1 2/2005 Liao et al.
6,860,793 B2 3/2005 Budinger et al.
6,860,802 B1 3/2005 Vishwanathan et al.
6,866,807 B2 3/2005 Comb et al.
6,869,350 B2 3/2005 Roberts et al.
6,875,096 B2 4/2005 Park et al.
6,875,097 B2 4/2005 Grunwald
6,896,593 B2 5/2005 Prasad
6,913,517 B2 7/2005 Prasad
6,935,931 B2 8/2005 Prasad
6,955,588 B1 10/2005 Anderson, II et al.
6,984,163 B2 1/2006 Roberts
6,991,517 B2 1/2006 Redeker et al.
6,991,528 B2 1/2006 Hu et al.
6,998,166 B2 2/2006 Prasad
7,077,879 B2 7/2006 Ogawa et al.
7,120,512 B2 10/2006 Kramer et al.
7,132,033 B2 11/2006 Boldizar et al.
7,169,030 B1 1/2007 Kulp
7,195,544 B2 3/2007 Prasad
7,252,871 B2 8/2007 Crkvenac et al.
7,264,641 B2 9/2007 Prasad
7,267,607 B2 9/2007 Prasad
7,300,619 B2 11/2007 Napadensky et al.
7,311,862 B2 12/2007 Prasad
7,371,160 B1 5/2008 Cruz et al.
7,377,840 B2 5/2008 Deopura et al.
7,425,172 B2 9/2008 Misra et al.
7,435,161 B2 10/2008 Prasad et al.
7,435,165 B2 10/2008 Prasad
7,438,636 B2 10/2008 Kulp et al.
7,445,847 B2 11/2008 Kulp
7,455,571 B1 11/2008 Kuo et al.
7,497,885 B2 3/2009 Kollodge
7,517,277 B2 4/2009 Muldowney
7,517,488 B2 4/2009 Saikin
7,524,345 B2 4/2009 Nevoret et al.
7,530,880 B2 5/2009 Bajaj et al.
7,531,117 B2 5/2009 Ederer et al.
7,537,446 B2 5/2009 James et al.
7,582,127 B2 9/2009 Vacassy et al.
7,635,290 B2 12/2009 Muldowney
7,699,684 B2 4/2010 Prasad
7,704,122 B2 4/2010 Misra et al.
7,704,125 B2 4/2010 Roy et al.
7,762,870 B2 7/2010 Ono et al.
7,815,778 B2 10/2010 Bajaj
7,828,634 B2 11/2010 Jiang et al.
7,846,008 B2 12/2010 Bajaj

(56) References Cited

U.S. PATENT DOCUMENTS 7,871,309 B2 1/2011 Ogawa et al.
7,875,091 B2 1/2011 Nevorct et al.
7,926,521 B2 4/2011 Izumoto et al.
7,976,901 B2 7/2011 Kume et al.
8,066,555 B2 11/2011 Bajaj
8,075,372 B2 * 12/2011 Prasad ..... B24B 37/26 451/529
8,075,745 B2 12/2011 Bajaj
8,118,641 B2 2/2012 Kulp et al.
8,142,860 B2 3/2012 Vanmaele et al.
8,142,869 B2 3/2012 Kobayashi et al.
8,177,603 B2 5/2012 Bajaj
8,211,543 B2 7/2012 Kato et al.
8,257,545 B2 9/2012 Loyack et al.
8,260,447 B2 9/2012 Mattes et al.
8,287,793 B2 10/2012 Deopura et al.
8,288,448 B2 10/2012 Kulp
8,292,692 B2 10/2012 Bajaj
8,349,706 B2 1/2013 Noda
8,360,830 B2 * 1/2013 Klug ..... B24D 13/08 451/529
8,377,623 B2 2/2013 Fong
8,380,339 B2 2/2013 Misra et al.
8,393,934 B2 3/2013 Sung
8,398,466 B2 3/2013 Sung et al.
8,546,717 B2 10/2013 Stecker
8,562,389 B2 10/2013 Benvegnu et al.
8,598,523 B2 12/2013 Stecker et al.
8,602,851 B2 12/2013 Lombardo et al.
8,647,179 B2 2/2014 Nakayama et al.
8,690,978 B2 4/2014 Arnaud et al.
8,702,479 B2 4/2014 Huang et al.
8,709,114 B2 4/2014 Cantrell et al.
8,715,035 B2 5/2014 Roy et al.
8,784,721 B2 7/2014 Philippi et al.
8,801,949 B2 8/2014 Lakrout et al.
8,821,214 B2 9/2014 Joseph
8,864,859 B2 10/2014 Roy et al.
8,883,392 B2 11/2014 Napadensky et al.
8,888,480 B2 11/2014 Yoo et al.
8,894,799 B2 11/2014 Lakrout
8,932,116 B2 1/2015 Deopura et al.
8,986,585 B2 3/2015 Cantrell et al.
9,017,140 B2 4/2015 Allison et al.
9,067,297 B2 6/2015 Allison et al.
9,067,299 B2 6/2015 Bajaj et al.
9,108,291 B2 8/2015 Lakrout
9,156,124 B2 10/2015 Allison et al.
9,162,340 B2 10/2015 Joseph et al.
9,162,341 B2 10/2015 LeFevre et al.
9,259,820 B2 2/2016 Qian et al.
9,259,821 B2 2/2016 Qian et al.
9,278,424 B2 3/2016 Roy et al.
9,296,085 B2 3/2016 Bajaj et al.
9,314,897 B2 4/2016 Qian et al.
9,333,620 B2 5/2016 Qian et al.
9,421,666 B2 8/2016 Krishnan et al.
9,457,520 B2 10/2016 Bajaj et al.
9,539,694 B1 * 1/2017 Kozhukh ..... B29C 70/66
9,587,127 B2 3/2017 Herlihy et al.
9,630,249 B2 4/2017 Toyserkani et al.
9,718,129 B2 8/2017 Ljungblad et al.
9,744,724 B2 8/2017 Bajaj et al.
9,776,361 B2 10/2017 Krishnan et al.
9,868,230 B2 1/2018 Dikovsky et al.
9,873,180 B2 1/2018 Bajaj et al.
9,951,054 B2 4/2018 Li et al.
9,969,049 B2 * 5/2018 Pai ..... B24B 37/26
9,993,907 B2 6/2018 Murugesh et al.
10,005,236 B2 6/2018 Yudovin-Farber et al.
10,245,704 B2 4/2019 Eilers et al.
10,456,886 B2 10/2019 Ganapathiappan et al.
2001/0008830 A1 7/2001 Tolles et al.
2001/0020448 A1 9/2001 Vaartstra et al.
2001/0041511 A1 11/2001 Lack et al.
2001/0046834 A1 11/2001 Ramana et al.
2002/0016139 A1 2/2002 Hirokawa et al.
2002/0058468 A1 5/2002 Eppert et al.
2002/0077036 A1 6/2002 Roberts et al.
2002/0112632 A1 8/2002 Faibish
2002/0173248 A1 11/2002 Doan et al.
2003/0019570 A1 1/2003 Chen et al.
2003/0022611 A1 1/2003 Bartlett et al.
2003/0056870 A1 3/2003 Comb et al.
2003/0134581 A1 7/2003 Wang et al.
2003/0153253 A1 8/2003 Hanamoto et al.
2003/0181137 A1 9/2003 Redeker et al.
2003/0205325 A1 11/2003 Boyd et al.
2003/0220061 A1 11/2003 Prasad
2004/0003895 A1 1/2004 Amano et al.
2004/0033758 A1 2/2004 Wiswesser
2004/0055223 A1 3/2004 Ono et al.
2004/0058623 A1 3/2004 Lin et al.
2004/0106367 A1 6/2004 Walker et al.
2004/0126575 A1 7/2004 Koshida et al.
2004/0133298 A1 7/2004 Toyserkani et al.
2004/0154533 A1 8/2004 Agarwal et al.
2004/0173946 A1 9/2004 Pfeifer et al.
2004/0175451 A1 9/2004 Maekawa et al.
2004/0180611 A1 9/2004 Tajima et al.
2004/0187714 A1 9/2004 Napadensky et al.
2004/0198185 A1 10/2004 Redeker et al.
2004/0224616 A1 11/2004 Shiho et al.
2005/0003189 A1 1/2005 Bredt et al.
2005/0020082 A1 1/2005 Vishwanathan et al.
2005/0032464 A1 2/2005 Swisher et al.
2005/0062900 A1 3/2005 Kim
2005/0086869 A1 4/2005 Park et al.
2005/0098540 A1 5/2005 Prasad
2005/0101228 A1 5/2005 Prasad
2005/0110853 A1 5/2005 Gardner et al.
2005/0153634 A1 7/2005 Prasad et al.
2005/0171224 A1 8/2005 Kulp
2005/0215177 A1 9/2005 Prasad
2005/0227590 A1 10/2005 Sung
2005/0261150 A1 11/2005 Yonker et al.
2005/0276967 A1 12/2005 Prasad
2005/0284536 A1 12/2005 Kojima et al.
2006/0019587 A1 1/2006 Deopura et al.
2006/0052040 A1 3/2006 Prasad
2006/0125133 A1 6/2006 Huh et al.
2006/0160478 A1 7/2006 Donohue et al.
2006/0185256 A1 8/2006 Nevoret et al.
2006/0192315 A1 8/2006 Farr et al.
2006/0226567 A1 10/2006 James et al.
2006/0252900 A1 11/2006 Bowman et al.
2006/0276109 A1 12/2006 Roy et al.
2007/0007698 A1 1/2007 Sano
2007/0009606 A1 1/2007 Serdy et al.
2007/0054599 A1 3/2007 Taylor et al.
2007/0117393 A1 5/2007 Tregub et al.
2007/0128874 A1 6/2007 Shida et al.
2007/0128991 A1 6/2007 Yoon et al.
2007/0149096 A1 6/2007 Nishimura et al.
2007/0212979 A1 9/2007 Preston
2007/0221287 A1 9/2007 Izumoto
2007/0235133 A1 10/2007 Benassi
2007/0235904 A1 10/2007 Saikin
2008/0009228 A1 1/2008 Nagase et al.
2008/0057845 A1 3/2008 Prasad
2008/0060734 A1 3/2008 Stehle
2008/0157436 A1 7/2008 Patel et al.
2008/0207100 A1 8/2008 Roy et al.
2008/0211141 A1 9/2008 Deopura et al.
2008/0255823 A1 10/2008 Grant
2008/0314878 A1 12/2008 Cai et al.
2009/0011679 A1 1/2009 Bajaj et al.
2009/0053976 A1 2/2009 Roy et al.
2009/0053983 A1 2/2009 Hosaka et al.
2009/0093201 A1 4/2009 Kazuno et al.
2009/0094902 A1 4/2009 Hou
2009/0105363 A1 4/2009 Napadensky
2009/0206065 A1 8/2009 Kruth et al.
2009/0253353 A1 10/2009 Ogawa et al.

(56) References Cited

U.S. PATENT DOCUMENTS

2009/0270019 A1 10/2009 Bajaj
2009/0311955 A1 12/2009 Kerprich et al.
2009/0321979 A1 12/2009 Hiraide
2010/0007692 A1 1/2010 Vanmaele et al.
2010/0011672 A1 1/2010 Kincaid et al.
2010/0087128 A1 4/2010 Nakayama et al.
2010/0112919 A1 5/2010 Bonner et al.
2010/0120249 A1 5/2010 Hirose et al.
2010/0120343 A1 5/2010 Kato et al.
2010/0140850 A1 6/2010 Napadensky et al.
2010/0203815 A1* 8/2010 Bajaj ..... B24B 37/26 451/526
2010/0210197 A1 8/2010 Matsumura et al.
2010/0323050 A1 12/2010 Kumagai et al.
2011/0011217 A1 1/2011 Kojima
2011/0059247 A1 3/2011 Kuzusako et al.
2011/0077321 A1 3/2011 Napadensky
2011/0130077 A1 6/2011 Litke et al.
2011/0171890 A1 7/2011 Nakayama et al.
2011/0180952 A1 7/2011 Napadensky
2011/0277877 A1 11/2011 Stehle
2012/0178845 A1 7/2012 Napadensky et al.
2012/0302148 A1 11/2012 Bajaj et al.
2012/0315830 A1 12/2012 Joseph et al.
2013/0012108 A1 1/2013 Li et al.
2013/0017769 A1 1/2013 Kimura
2013/0019570 A1 1/2013 Weible
2013/0055568 A1 3/2013 Dusel et al.
2013/0059506 A1 3/2013 Qian et al.
2013/0059509 A1 3/2013 Deopura et al.
2013/0102231 A1 4/2013 Joseph et al.
2013/0122705 A1 5/2013 Babu et al.
2013/0137350 A1 5/2013 Allison et al.
2013/0172509 A1 7/2013 Pawloski et al.
2013/0183824 A1 7/2013 Kwon et al.
2013/0212951 A1 8/2013 Ahn et al.
2013/0231032 A1 9/2013 Swedek et al.
2013/0283700 A1 10/2013 Bajaj et al.
2013/0307194 A1 11/2013 Elsey
2013/0309951 A1 11/2013 Benvegnu et al.
2013/0316081 A1 11/2013 Kovalcik et al.
2013/0328228 A1 12/2013 Pettis et al.
2014/0048970 A1 2/2014 Batchelder et al.
2014/0065932 A1 3/2014 Kazuno et al.
2014/0117575 A1 5/2014 Kemperle et al.
2014/0163717 A1 6/2014 Das et al.
2014/0206268 A1 7/2014 Lefevre et al.
2014/0239527 A1 8/2014 Lee
2014/0324206 A1 10/2014 Napadensky
2014/0364044 A1 12/2014 Ahn et al.
2014/0370214 A1 12/2014 Araki et al.
2014/0370788 A1 12/2014 Nair
2015/0024233 A1 1/2015 Gunther
2015/0031781 A1 1/2015 Landers et al.
2015/0037601 A1 2/2015 Blackmore
2015/0038066 A1 2/2015 Huang et al.
2015/0045928 A1 2/2015 Perez et al.
2015/0056421 A1 2/2015 Yudovin-Farber et al.
2015/0056892 A1 2/2015 Vacassy et al.
2015/0056895 A1 2/2015 Fotou et al.
2015/0056900 A1* 2/2015 Bajaj ..... B24D 18/0009 264/45.3
2015/0061170 A1 3/2015 Engel et al.
2015/0065020 A1 3/2015 Roy et al.
2015/0084238 A1 3/2015 Bonassar et al.
2015/0093977 A1 4/2015 Deopura et al.
2015/0115490 A1 4/2015 Reinarz
2015/0123298 A1 5/2015 Napadensky
2015/0126099 A1 5/2015 Krishnan et al.
2015/0129798 A1 5/2015 Napadensky
2015/0174826 A1 6/2015 Murugesh et al.
2015/0216790 A1 8/2015 Feng et al.
2016/0052103 A1 2/2016 Qian et al.
2016/0068996 A1 3/2016 Lau et al.
2016/0101500 A1 4/2016 Fung et al.
2016/0107287 A1 4/2016 Bajaj et al.
2016/0107288 A1 4/2016 Orilall et al.
2016/0107290 A1 4/2016 Bajaj et al.
2016/0107295 A1 4/2016 Bajaj et al.
2016/0107381 A1* 4/2016 Krishnan ..... B24B 37/22 451/527
2016/0114458 A1 4/2016 Bajaj et al.
2016/0136787 A1 5/2016 Bajaj et al.
2016/0176021 A1 6/2016 Orilall et al.
2016/0221145 A1 8/2016 Huang et al.
2016/0229023 A1 8/2016 Lugg et al.
2016/0236279 A1 8/2016 Ashton et al.
2016/0271869 A1 9/2016 Van De Vrie et al.
2016/0279757 A1 9/2016 Qian et al.
2016/0346997 A1 12/2016 Lewis et al.
2016/0354901 A1 12/2016 Krishnan et al.
2016/0375546 A1 12/2016 Pai et al.
2017/0036320 A1 2/2017 Prasad
2017/0100817 A1 4/2017 Ganapathiappan et al.
2017/0120416 A1 5/2017 Chockalingam et al.
2017/0136603 A1 5/2017 Ganapathiappan et al.
2017/0148539 A1 5/2017 Prestayko et al.
2017/0151648 A1 6/2017 Huang et al.
2017/0173865 A1 6/2017 Dikovsky et al.
2017/0182629 A1 6/2017 Lehuu et al.
2017/0203406 A1 7/2017 Ganapathiappan et al.
2017/0203408 A1 7/2017 Ganapathiappan et al.
2017/0203409 A1 7/2017 Lefevre et al.
2017/0239886 A1 8/2017 Norikane
2018/0043613 A1 2/2018 Krishnan et al.
2018/0161954 A1 6/2018 Bajaj et al.
2018/0236632 A1 8/2018 Murugesh et al.
2018/0281154 A1* 10/2018 Chen ..... B24B 37/22
2018/0339402 A1 11/2018 Redfield et al.
2019/0030678 A1 1/2019 Kumar et al.
2019/0218697 A1 7/2019 Nakayama et al.
2020/0001433 A1 1/2020 Bajaj et al.
2020/0156311 A1 5/2020 Rolland et al.
2021/0187693 A1* 6/2021 Khanna ..... B24B 37/042
2022/0250203 A1* 8/2022 Jawali ..... B33Y 80/00
2022/0395958 A1* 12/2022 Wewala Gonnagahadeniyage ..... B24B 37/26

FOREIGN PATENT DOCUMENTS

CN 101612722 A 12/2009
CN 203542340 U 4/2014
CN 105408063 A 3/2016
CN 103465155 B 5/2016
CN 104400998 B 10/2016
CN 104607639 B 11/2016
CN 104625945 B 3/2017
CN 104385595 B 5/2017
CN 104210108 B 11/2017
DE 19834559 A1 2/2000
DE 10314075 B4 11/2007
EP 1419876 B1 4/2008
JP H0267171 A 3/1990
JP H08132342 A 5/1996
JP 09076353 A 3/1997
JP 11254542 A 9/1999
JP 11347761 A 12/1999
JP 2000061817 A 2/2000
JP 2002151447 A 5/2002
JP 2003303793 A 10/2003
JP 2004235446 A 8/2004
JP 2004243518 A 9/2004
JP 2004281685 A 10/2004
JP 2005074614 A 3/2005
JP 3801100 B2 7/2006
JP 2006231464 A 9/2006
JP 2009291942 A * 12/2009
JP 4693024 B2 6/2011
JP 4798713 B2 10/2011
JP 5143528 B2 2/2013
JP 2013107254 A 6/2013
JP 2016023209 A 2/2016
KR 20030020658 A 3/2003
KR 20050022654 A 3/2005

(56) References Cited

FOREIGN PATENT DOCUMENTS

| | | | |
|---|---|---|---|
| KR | 20050052876 | A | 6/2005 |
| KR | 100842486 | B1 | 7/2008 |
| KR | 20100028294 | A | 3/2010 |
| WO | 9830356 | A1 | 7/1998 |
| WO | 9849723 | A1 | 11/1998 |
| WO | 0164396 | A1 | 9/2001 |
| WO | 0224415 | A1 | 3/2002 |
| WO | 02070200 | A1 | 9/2002 |
| WO | 2009158665 | A1 | 12/2009 |
| WO | 2010088246 | A1 | 8/2010 |
| WO | 2012173885 | A2 | 12/2012 |
| WO | 2014039378 | A1 | 3/2014 |
| WO | 2015168529 | A1 | 11/2015 |
| WO | 2017066077 | A1 | 4/2017 |

OTHER PUBLICATIONS

The Dow Chemical Company—"DOW VLDPE DFDB-1085 NT, Very Low Density Polyethylene Resin" Technical Data, UL Prospector, Oct. 2003, 2 pages.

Andrews, Rodney J., et al.—"Glass Transition Temperatures of Polymers," Polymer Handbook, Fourth Edition, J. Brandrup et al., Editors, A Wiley Interscience Publication, John Wiley & Sons, Inc., 1999, VI / 193-198.

Whisnaut, David—"Polymer Chemistry: The Glass Transition" webpage, Engineering Libre Texts, https://eng.libretexts.org/Bookshelves/Materials_Schience?Supplemental_Modules_Materia . . . , printed Apr. 10, 2019, 2 pages.

Sigma-Aldrich—"Thermal Transitions of Homopolymers: Glass Transition & Melting Point" webpage, https://www.sigmaaldrich.com/technical-documents/articles/materials-science/polymer-scie . . . , printed Apr. 8, 2019, 3 pages.

Antje M.J. Van Den Berg, "Inkjet Printing of Polyurethane Colloidal Suspensions", www.rsc.org/softmatter. Jul. 13, 2006.

Peter Krober et al. "Reactive Inkjet Printing of Polyurethanes", www.rsc.org/materials. Journal of Materials Chemistry. Jan. 6, 2009.

Plastics in Action; 3-D Printing Speeds Prototype Development dated May/Jun. 1998; 2 total pages.

Shahrubudin, N., et al.—"An Overview on 3D Printing Technology: Technological, Materials, and Applications," 2nd International Conference on Sustainable Materials Processing and Manufacturing (SMPM 2019), Procedia Manufacturing, 35 (2019), published by Elsevier B.V., pp. 1286-1296.

U.S. Appl. No. 17/036,623, filed Sep. 29, 2020, entitled "Polishing Pads Having Selectively Arranged Porosity".

Rodel. Rodel IC1000 CMP Pad. 1999. 2 pages.

Byoung-Ho Kwon et al. "Dishing and Ersosion in STI CMP". System IC R&D Center, Hyundai Electronics Industries Co. Ltd. 1999 IEEE. 3 pages.

S. Raghavan et al. "Chemical Mechanical Planariarization in Integrated Circuit Device Manufacturing". vol. 98-7. 1998. 19 pages.

Rajeev Bajaj et al. "Effect of Polishing Pad Material Properties on Chemical Mechanical Polishing (CMP) Processes". 1994. 8 pages.

Rodel. Rodel IC1010. 1998. 2 pages.

Peter Freeman et al. "A Study of the Variation of Physical Properties in Random Lots of Urethane Polishing Pads for CMP". A Rodel Publication. vol. 2, Issue 6. Jun. 1996. 8 Pages.

John J. Aklonis et al. "Introduction to Polymer Viscoelasticity". Second Edition. 1983. 6 pages.

Weidan Li et al. "The Effect of the Polishing Pad Treatments on the Chemical-Mechanical Polishing of SiO2 Films", Thin Solid Films 270 (1995). 6 pages.

Yu-Lim Jun et al. "Slicing Bitmap Generation and Patterning Technique a SFF System Using UV-Resin", International Conference on Control, Automation and Systems 2007. 5 Pages.

H. Yang. "High Viscosity Jetting System for 3D Reactive Inkjet Printing", Additive Manufacturing and 3D Printing Group, University of Nottingham. 9 pages.

I Hermant et al. "A Comparative Study of Polyurethane-Poly(Methyl Methacrylate) Interpenetrating and Semi-1 Interprenetrating Polymer Networks", vol. 20, No. 1. pp. 85-89, 1984.

Lee M. Cook. "CMP Consumables II: Pad" Chapter 6. Semiconductors and Semimetals, vol. 63. Published 1999. Chemical Mechanical Polishing in Silicon Processing. ISBN: 978-0-12-752172-5.

International Search Report and the Written Opinion of the International Searching Authority for PCT/US2021/012370 dated Jun. 24, 2021.

* cited by examiner

ADVANCED POLISHING PADS AND RELATED POLISHING PAD MANUFACTURING METHODS

BACKGROUND

Field

Embodiments of the present disclosure generally relate to polishing pads, and methods of manufacturing polishing pads, and more particularly, to polishing pads used for chemical mechanical polishing (CMP) of a substrate in an electronic device fabrication process.

Description of the Related Art

Chemical mechanical polishing (CMP) is commonly used in the manufacturing of high-density integrated circuits to planarize or polish a layer of material deposited on a substrate. In a typical CMP process, a polishing pad is mounted to a platen, which is rotated about an axis at its center to rotate the pad in a plane around this same axis. A material surface of a substrate is urged against a polishing pad in the presence of a polishing fluid comprising an aqueous solution of one or more chemically active components and abrasive particles suspended in the aqueous solution, i.e., a CMP slurry. Typically, the polishing fluid is delivered to the interface between the material surface of the substrate and the polishing pad, i.e., the polishing interface, by virtue of the relative motion therebetween. For example, the polishing fluid may be dispensed onto a surface of the polishing pad and delivered to polishing interface by the movement of the polishing pad under the substrate. Often, the polishing pad is formed and/or conditioned to have grooves, pores, and surface asperities that facilitate polishing fluid transport to the polishing interface.

One common application of a CMP process in semiconductor device manufacturing is planarization of a bulk film, for example pre-metal dielectric (PMD) or interlayer dielectric (ILD) polishing, where underlying two or three-dimensional features create recesses and protrusions in the surface of the to be planarized material surface. Other common applications of CMP processes in semiconductor device manufacturing include shallow trench isolation (STI) and interlayer metal interconnect formation, where the CMP process is used to remove the via, contact or trench fill material (overburden) from the exposed surface (field) of the layer of material having the STI or metal interconnect features disposed therein.

Polishing pads are typically selected based on the suitability of the polishing pad's performance for the particular CMP application. For example, in a metal interconnect CMP application, metal loss resulting from poor local planarization can cause undesirable variation in the effective resistance of the metal features, thus effecting device performance and reliability. Accordingly, a polishing pad may be selected for a metal interconnect CMP application based on its superior localized planarization performance when compared to other polishing pads. Generally, polishing pads formed of comparatively harder materials and/or having relatively low porosity provide superior local planarization performance when compared to polishing pads formed of softer and/or more porous materials.

Unfortunately, polishing pads formed of harder and/or low porosity materials are also associated with increased defectivity, such as undesirable scratches in a substrate surface, when compared with softer and/or more porous polishing pads. Unlike other types of defectivity, e.g., particles, scratches cause permanent damage to the substrate surface and cannot be removed in a subsequent cleaning process. For example, even a light scratch that extends across multiple lines of metal interconnects can smear traces of the metallic ions disposed therein across the material layer being planarized and thereby induce leakage current and time-dependent dielectric break down in a resulting semiconductor device, thus effecting the reliability of the resulting device. More severe scratches can cause adjacent metal lines to undesirably twist and bridge together and/or cause disruptions and missing patterns in the substrate surface, which undesirably results in short circuits, and ultimately, device failure thus suppressing the yield of usable devices formed on the substrate. Both poor local planarization performance and scratch induced defectivity become increasingly problematic as circuit densities increase and the dimensions thereof are reduced to the sub-micron scale.

Accordingly, there is a need in the art for polishing pads, and methods of manufacturing polishing pads, that concurrently solve the problems described above.

SUMMARY

Embodiments described herein generally relate to polishing pads, and methods for manufacturing polishing pads which may be used in a chemical mechanical polishing (CMP) process. More particularly, embodiments herein provide for polishing pads having selectively arranged pore-features to define discrete alternating regions of relatively high and low porosity across the polishing pad surface and additive manufacturing methods of forming the polishing pads.

In one embodiment, a polishing pad having a polishing surface that is configured to polish a substrate is provided. The polishing pad includes a polishing layer. At least a portion of the polishing layer comprises a continuous phase of polishing material featuring a plurality of first regions having a first pore-feature density and a plurality of second regions having a second pore-feature density that is different from the first pore-feature density. Here, the plurality of first regions are distributed in a pattern in an X-Y plane of the polishing pad in a side-by-side arrangement with the plurality of second regions and individual portions or ones of the plurality of first regions are interposed between individual portions or ones of the plurality of second regions. Here, the first and second pore-feature densities comprise a cumulative area of a plurality of pore-features as a percentage of total area of the respective first and second regions in the X-Y plane. The plurality of pore-features comprises openings defined in a surface of the polishing layer, voids that are formed in the polishing material below the surface, pore-forming features comprising a water-soluble-sacrificial material, or combinations thereof. The X-Y plane is parallel to the polishing surface of the polishing pad, and the individual portions or ones of the plurality of first regions interposed between the individual portions or ones of the plurality of second regions comprise at least a continuous area defined by a first circle in the X-Y plane having a first radius equal to or greater than about 100 μm.

In another embodiment, a polishing pad features a foundation layer and a polishing layer disposed on the foundation layer. The polishing layer is integrally formed with the foundation layer to provide a continuous phase of polymer material across interfacial boundary regions there between. Here, the polishing layer features a plurality of first regions having a first pore-feature density and a plurality of second regions comprising a plurality of pore-features to provide a second pore-feature density of about 2% or more. In this embodiment, at least portions of the first regions are spaced apart from one another in an X-Y plane of the polishing pad by at least portions of the second regions, the first and second pore-feature densities comprise a cumulative area of a plurality of pore-features as a percentage of total area of the respective first and second regions in the X-Y plane, the plurality of pore-features comprises openings defined in a surface of the polishing layer, voids that are formed in the polishing material below the surface, pore-forming features comprising a water-soluble-sacrificial material, or combinations thereof, the first pore-feature density is about ½ or less of the second pore-feature density, and individual ones of the plurality of pore-features in the plurality of second regions have a height in a Z direction that is about ½ or less than a diameter of the pore measured in the X-Y plane. Here, the X-Y plane is parallel to the polishing surface of the polishing pad, the Z direction is orthogonal to the X-Y plane, and the plurality of first and second regions form a continuous phase of polymer material across the interfacial boundary regions there between.

In another embodiment, a method of forming a polishing pad is provided. In this embodiment, the method includes forming a polishing layer featuring a plurality of first regions having a first pore-feature density and a plurality of second regions having a second pore-feature density. Here, the plurality of first regions are distributed in a pattern across an X-Y plane parallel to a polishing surface of the polishing layer and are disposed in a side-by-side arrangement with the plurality of second regions. The first and second pore-feature densities comprise an area void-space as a percentage of total area of the respective first and second regions in the X-Y plane and the second pore-feature density is about 2% or more and the first pore-feature density is about ½ or less of the second pore-feature density. Forming the polishing layer typically includes sequential repetitions of forming one or more adjoining first print layers and forming one or more adjoining second print layers on a surface of the one or more adjoining first print layers. Here, forming a first print layer comprises dispensing droplets of one or more pre-polymer compositions and droplets of a sacrificial-material composition onto a surface of a previously formed print layer and exposing the dispensed droplets to electromagnetic radiation. Forming a second print layer includes dispensing droplets of the one or more pre-polymer compositions onto a surface of a previously formed print layer and exposing the dispensed droplets to electromagnetic radiation. Here, the droplets of sacrificial-material composition are dispensed according to a first pattern to form a plurality of pore-features in the second regions. A height of individual ones of the plurality of pore-features is determined by a thickness of the one or more adjoining first print layers. The droplets used to form the second print layers are dispensed according to a second pattern to form a layer of polymer material. The individual ones of the plurality of pore-features are spaced apart in a Z direction by the layer of polymer material. The spacing of the individual pore-features in the Z direction is determined by a thickness of the one or more adjoining second print layers disposed therebetween.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
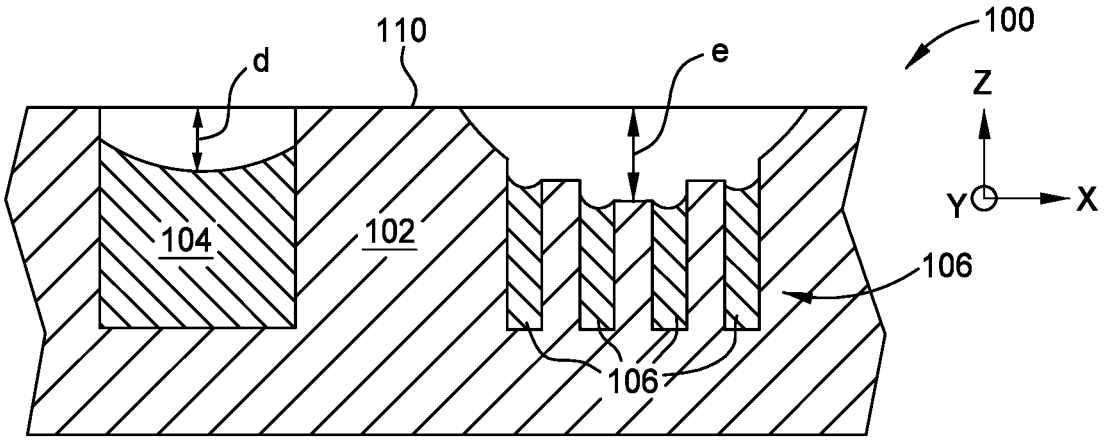
FIG. 1A (PRIOR ART)
FIG. 1A a schematic sectional view illustrating local planarization of a portion of a substrate following a chemical mechanical polishing (CMP) process using a conventional polishing pad.

To facilitate understanding, identical reference numerals have been used, where possible, to designate identical elements that are common to the figures. It is contemplated that elements and features of one implementation may be beneficially incorporated in other implementations without further recitation.

DETAILED DESCRIPTION

Embodiments described herein generally relate to polishing pads, and methods for manufacturing polishing pads, which may be used in a chemical mechanical polishing (CMP) process. In particular, the polishing pads described herein feature spatially arranged, i.e., spaced apart, micro-regions of relatively low and relatively high pore-feature density, which together, form a continuous polymer phase of polishing pad material.

Figure 1B:
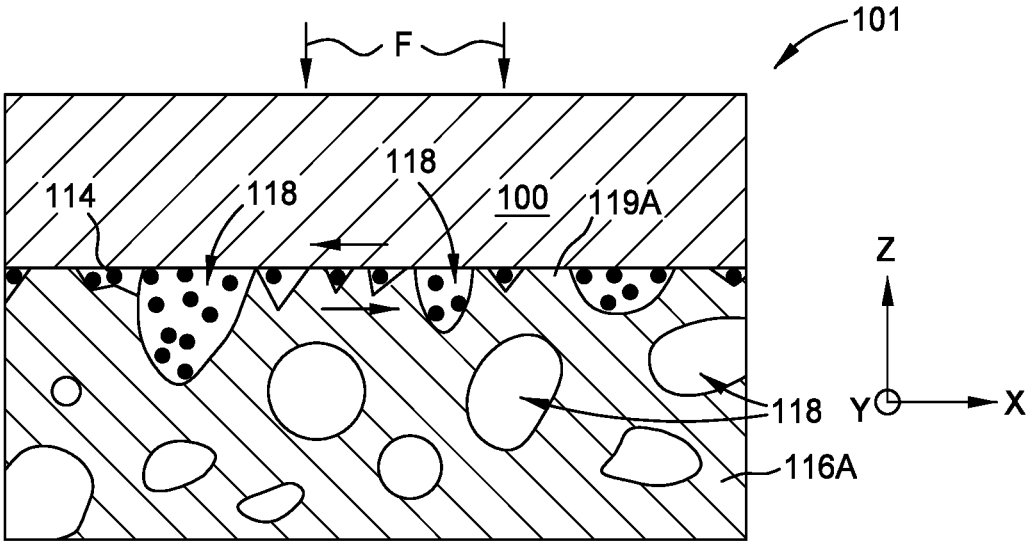
FIG. 1B is a schematic sectional view of a polishing interface of a relatively porous polishing pad and a substrate urged thereagainst.
Figure 1C:
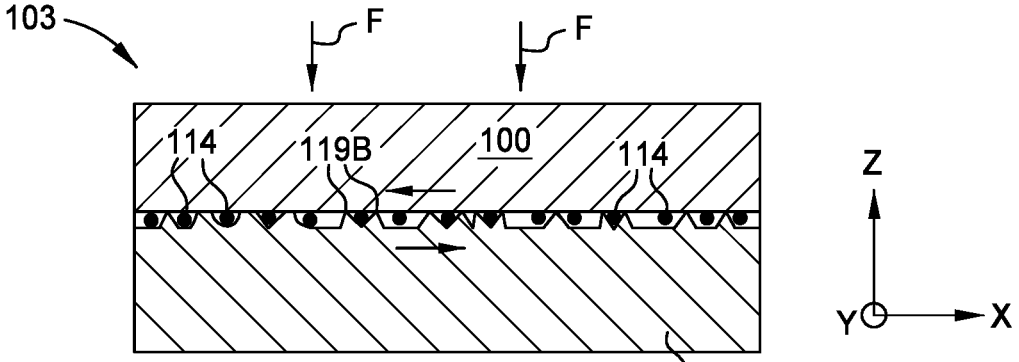
FIG. 1C is a schematic sectional view of a polishing interface of a non-porous polishing pad and a substrate urged thereagainst.

Undesirably poor local planarization performance typically associated with conventional polishing pads formed of relatively softer materials and/or having a generally uniform porosity is schematically illustrated in FIG. 1A. A portion of a polishing interface between a substrate and a polishing pad having a relatively high porosity is schematically illustrated in FIG. 1B. A portion of a polishing interface between a substrate and a polishing pad formed of a relatively hard non-porous material is schematically illustrated in FIG. 1C.

FIG. 1A is a schematic sectional view illustrating poor local planarization, e.g., erosion to a distance e and dishing to a distance d, following a CMP process to remove an overburden of metal fill material from the field, i.e., upper or outer, surface of a substrate 100. Here, the substrate 100 features a dielectric layer 102, a first metal interconnect feature 104 formed in the dielectric layer 102, and a plurality second metal interconnect features 106 formed in the dielectric layer 102. The plurality of second metal interconnect features 106 are closely arranged to form a region 107 of relatively high feature density. Typically, the metal interconnect features 104, 106 are formed by depositing a metal fill material onto the dielectric layer 102 and into corresponding openings formed therein. The material surface of the substrate 100 is then planarized using a CMP process to remove the overburden of fill material from the field surface 110 of the dielectric layer 102. If the polishing pad selected for the CMP process provides relatively poor local planarization performance, the resulting upper surface of the metal interconnect feature 104 may be recessed a distance d from the surrounding surfaces of the dielectric layer 102, otherwise known as dishing. Poor local planarization performance may also result in undesirable recessing of the dielectric layer 102 in the high feature density region 108, e.g., distance e, where the upper surfaces of the dielectric layer 102 in the region 108 are recessed from the plane of the field surface 110, otherwise known as erosion. Metal loss resulting from dishing and/or erosion can cause undesirable variation in the effective resistance of the metal features 104, 106 formed therefrom thus effecting device performance and reliability.

FIG. 1B is a schematic sectional view of a polishing interface 101 between a substrate 100 and a polishing pad 116A having a relatively high porosity, e.g., pores 118. Typically, pores 118 formed immediately below the surface of the polishing pad 116A are exposed or opened during a polishing pad conditioning process, e.g., by urging an abrasive conditioning disk thereagainst. The exposed pores 118 at the surface of the polishing pad 116A and resulting asperities 119A (e.g., surface roughness) formed therebetween facilitate polishing fluid transport to the polishing interface. Here, the polishing fluid includes abrasive particles 114 suspended therein. The asperities 119A in the surface of the polishing pad 116A temporarily fix the abrasives particles 114 (abrasive capture) in relation to the substrate surface to enable chemical and mechanical material removal therefrom.

In a conventional polishing pad manufacturing process, pores are introduced into the polishing material of the polishing pad by blending a pre-polymer composition with a foaming agent before molding and curing the foamed pre-polymer composition into individual polishing pads, or into a polymer cake and machining, e.g., skiving, individual polishing pads therefrom. The resulting pores 118 are distributed throughout the pad material and thus increase the bulk compliance, e.g., compressibility and deformability, thereof. The pad asperities 119A are disposed between the bulk material of the polishing pad and the substrate surface and act as individual springs, e.g., load distribution points, when the substrate is urged thereagainst.

FIG. 1C is a schematic sectional view of a polishing interface 103 between a substrate 100 and a polishing pad 116B. Here, the polishing pad 116B is formed of the same material as the polishing pad 116A but is generally non-porous. Without the pores 118, the bulk material of the polishing pad 116B is less compliant than that of the polishing pad 116A and the surface asperities 119B formed thereon may be fewer and are generally smaller. As a result, the point-load on each of the surface asperities 119B is more than that of the point-load on the individual asperities 119A of the polishing pad 116A for the same relative force between the pad and the substrate.

Without intending to be bound by theory, it is believed that polishing pads having a relatively high porosity, and the increased surface asperities associated therewith, provide a higher asperity-substrate contact area than polishing pads formed of the same polymer material and having a lower porosity. It is similarly believed that the contact area between the surface of a polishing pad and a material surface of a substrate increases for comparatively softer polishing materials due to the more compliant material deforming by the force of the substrate urged thereagainst. The increase in contact area desirably reduces the contact pressure between the material surface of the substrate and individual asperities of the polishing pad and/or between abrasive particles interposed in the polishing interface therebetween by increasing the surface area of contact for a given force as compared to a less compliant pad, thus reducing the point-load on individual asperities and abrasive particles captured therein. The reduced point-load on polishing pad asperities and individual abrasive particles captured therein reduces the number of occurrences and/or depth of surface damage to the substrate, e.g., scratches, which may be caused therefrom.

Unfortunately, polishing pads selected to provide lower defectivity are also associated with poor local planarization performance, such as the erosion and dishing described in FIG. 1A. Without intending to be bound by theory, it is believed the relatively poor local planarization performance of the softer and/or more porous polishing pad is due, at least in part, to the more compliant bulk polishing pad material, and the asperities disposed thereon, being able to deform into recessed regions of the substrate surface and thereby into a material therein which is relatively softer than the material of the layer they are in and softer than the surrounding field surface. Thus, polishing pads formed of a relatively harder material and having a relatively low porosity, which typically have a comparatively lower bulk material compliance, generally provide superior localized planarization performance when compared to polishing pads formed of softer and/or more porous materials, but are more likely to scratch the surface being planarized.

Advantageously, the spatially arranged micro-regions of different pore-feature density regions in embodiments described herein provide both superior local planarization performance and improved surface finish when compared to polishing pads having a relatively uniform porosity across the material that forms the polishing surface.

Although embodiments described herein are generally related to chemical mechanical polishing (CMP) pads used in semiconductor device manufacturing, the polishing pads and manufacturing methods thereof are also applicable to other polishing processes using both chemically active and chemically inactive polishing fluids and/or polishing fluids free from abrasive particles. In addition, embodiments described herein, alone or in combination, may be used in at least the following industries: aerospace, ceramics, hard disk drive (HDD), MEMS and Nano-Tech, metalworking, optics and electro-optics manufacturing, and semiconductor device manufacturing, among others.

Exemplary Polishing System

Figure 2:
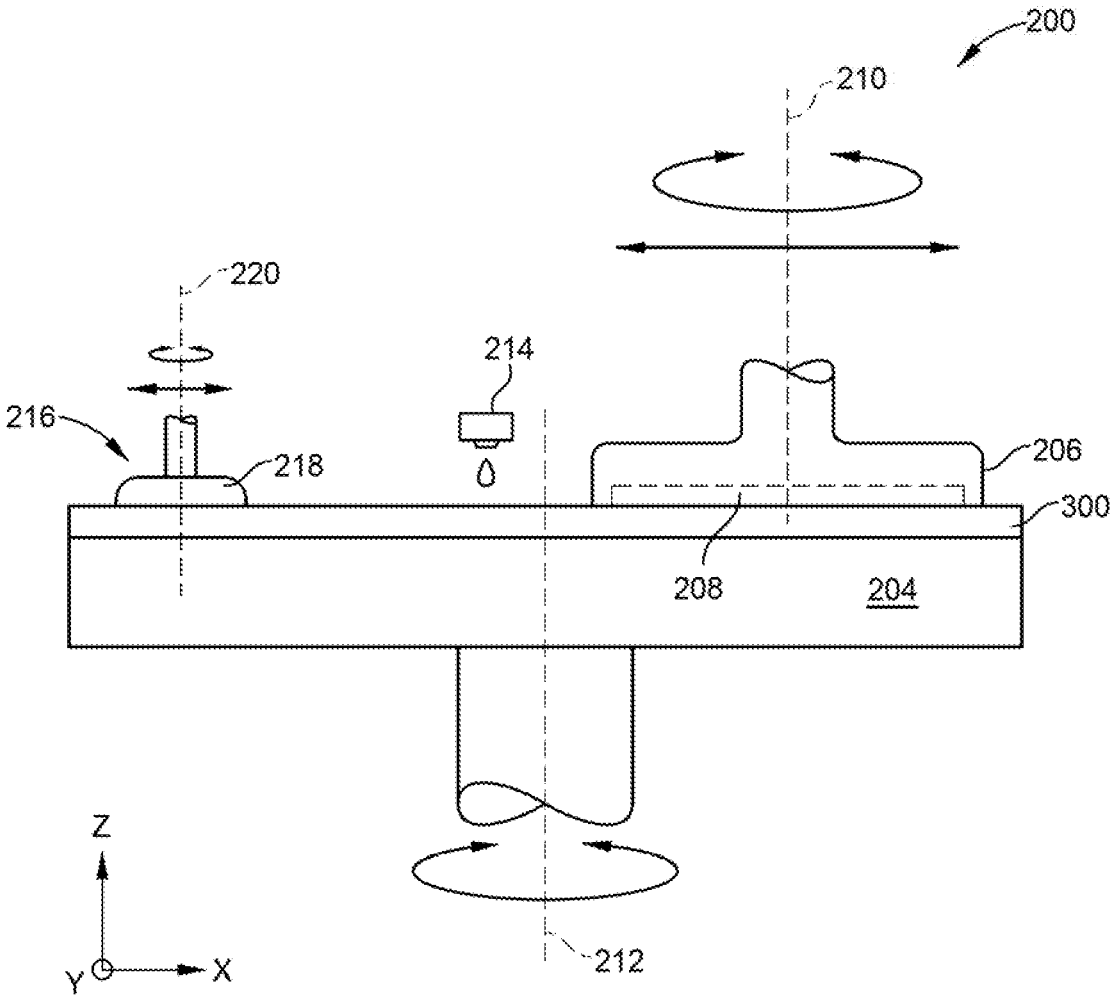
FIG. 2 is a schematic side view of an exemplary polishing system configured to use a polishing pad formed according embodiments described herein.

FIG. 2 is a schematic side view of an exemplary polishing system 200 configured to use a polishing pad 300 formed according to embodiments described herein. The polishing pad 300 is further described in FIGS. 3A-3C.

Here, the polishing system 200 features a platen 204, having the polishing pad 300 secured thereto using a pressure sensitive adhesive, and a substrate carrier 206. The substrate carrier 206 faces the platen 204 and the polishing pad 300 mounted thereon. The substrate carrier 206 is used to urge a material surface of a substrate 208, disposed therein, against the polishing surface of the polishing pad 300 while simultaneously rotating about a carrier axis 210. Typically, the platen 204 rotates about a platen axis 212 while the rotating substrate carrier 206 sweeps back and forth from an inner diameter to an outer diameter of the platen 204 to, in part, reduce uneven wear of the polishing pad 300.

The polishing system 200 further includes a fluid delivery arm 214 and a pad conditioner assembly 216. The fluid delivery arm 214 is positioned over the polishing pad 300 and is used to deliver a polishing fluid, such as a polishing slurry having abrasives suspended therein, to a surface of the polishing pad 300. Typically, the polishing fluid contains a pH adjuster and other chemically active components, such as an oxidizing agent, to enable chemical mechanical polishing of the material surface of the substrate 208. The pad conditioner assembly 216 is used to condition the polishing pad 300 by urging a fixed abrasive conditioning disk 218 against the surface of the polishing pad 300 before, after, or during polishing of the substrate 208. Urging the conditioning disk 218 against the polishing pad 300 includes rotating the conditioning disk 218 about a conditioner axis 220 and sweeping the conditioning disk 218 from an inner diameter the platen 204 to an outer diameter of the platen 204. The conditioning disk 218 is used to abrade and rejuvenate the polishing pad 330 polishing surface, and to remove polish byproducts or other debris from the polishing surface of the polishing pad 300.

Polishing Pad Examples

The polishing pads described herein include a foundation layer and a polishing layer disposed on the foundation layer. The polishing layer forms the polishing surface of the polishing pad and the foundation layer provides support for the polishing layer as a to-be-polished substrate is urged thereagainst. The foundation layer and the polishing layer are formed of different pre-polymer compositions that, when cured, have different material properties. The foundation layer and the polishing layer are integrally and sequentially formed using a continuous layer-by-layer additive manufacturing process. The additive manufacturing process provides a polishing pad body having a continuous polymer phase between the polishing layer and the foundation layer thus eliminating the need for an adhesive layer or other bonding method therebetween. In some embodiments, the polishing layer is formed of a plurality of polishing elements, which are separated from one another across the polishing surface by recesses, and/or channels, disposed therebetween.

The term "pore-feature," as used herein includes openings defined in the polishing surface, voids that are formed the polishing material below the polishing surface, pore-forming features disposed in the polishing surface, pore-forming features disposed in polishing material below the polishing surface, and combinations thereof. Pore-forming features typically comprise a water-soluble-sacrificial material that dissolves upon exposure to a polishing fluid thus forming a corresponding opening in the polishing surface and/or void in the polishing material below the polishing surface. In some embodiments, the water-soluble-sacrificial material may swell upon exposure to a polishing fluid thus deforming the surrounding polishing material to provide asperities at the polishing pad material surface. The resulting pores and asperities desirably facilitate transporting liquid and abrasives to the interface between the polishing pad and a to-be-polished material surface of a substrate, and temporarily fixes those abrasives (abrasive capture) in relation to the substrate surface to enable chemical and mechanical material removal therefrom.

The term "pore-feature density," as used herein refers to the cumulative area comprising pore-features in an X-Y plane of a given sample as a percentage of the total area of the given sample in the X-Y plane, such as the cumulative area comprising pore-features in a pore-feature density micro-region in the polishing surface of a polishing pad or in an X-Y plane parallel thereto. The term "porosity," as used herein refers to the volume of pore-feature space as a percentage of the total bulk volume in a given sample. In embodiments where a pore-feature, as defined herein, comprises a pore-forming feature formed of a sacrificial material the pore-feature density and porosity are measured after the sacrificial material forming the feature is dissolved therefrom.

Pore-feature density, porosity, and pore size may be determined using any suitable method, such as by methods using a scanning election microscopy (SEM) or an optical microscope. Techniques and systems for characterizing pore-feature density, porosity, and pore size are well known in the art. For example, a portion of the surface can be characterized by any suitable method (e.g., by electron microscope image analysis, by atomic force microscopy, by 3D microscopy, etc.). In one implementation, the pore-feature density and pore size analysis can be performed using a VK-X Series 3D UV Laser Scanning Confocal Microscope, produced by KEYENCE Corporation of America, located in Elmwood Park, N.J., U.S.A.

The term "spatially arranged pore-feature density regions," as used herein refers to the arrangement of micro-regions of polishing material having different pore-feature densities across a polishing surface of the polishing pad and extending thereinto in a direction orthogonal to the polishing surface. For example, in some embodiments, relatively low and relatively high pore-feature density regions are distributed, with respect to one another, in one or both directions of an X-Y plane parallel to a polishing surface of the polishing pad (i.e., laterally) and in a Z-direction which is orthogonal to the X-Y planes, i.e., vertically. Thus, at least portions of the relatively low pore-feature density regions are spatially separated, i.e., spaced apart from one another, by at least portions of the relatively high pore-feature density regions interposed therebetween. "Micro-regions," as used herein refers to a plurality of regions within a given sample of the polishing surface of the polishing pad and extending in a thickness direction (Z-direction) thereinto.

In some embodiments, the respective micro-regions of different pore-feature densities are also formed from different pre-polymer compositions, or different ratios of the different pre-polymer compositions, to provide spatially arranged material micro-domains, each having unique material properties. The term "spatially arranged material micro-domains" as used herein refers to the distribution of material domains, respectively formed from at least two different pre-polymer compositions within a micro-region of pore-feature density. In some embodiments, individual ones of the micro-regions of relatively low pore-feature density and/or relatively high pore-feature density, e.g., the first pore-feature density regions 308A and/or the second pore-feature density regions 308B, feature a plurality spatially arranged material micro-domains which collectively form at least portions of the polishing material of the polishing pad.

Herein, the different material micro-domains are distributed, with respect to one another, in one or both directions of the X-Y plane parallel to a polishing surface of the polishing pad (i.e., laterally) and in a Z direction which is orthogonal to the X-Y planes, i.e., vertically. At least portions of material micro-domains formed from the same pre-polymer composition are spatially separated, i.e., spaced apart from one another, by at least portions of material micro-domains formed from a different precursor composition interposed therebetween. The at least two different pre-polymer compositions are at least partially polymerized upon at least partial curing thereof to prevent or limit intermixing of the materials of the domains and thereby form the different material micro-domains which comprise differences in one or more material properties from one another adjacent to, and in contact with, each other.

Herein, the continuous polymer phases between different material layers, between different micro-regions, and/or between different material micro-domains are formed by the at least partial copolymerization of different pre-polymer compositions, or different ratios of at least two pre-polymer compositions, at interfacial boundary regions thereof. The different pre-polymer compositions include different monomer or oligomer species from one another and the interfacial boundary regions disposed at the adjoining locations between the different micro-regions and/or material micro-domains feature the different monomer or oligomer species linked by covalent bonds to form a copolymer thereof. In some embodiments, the copolymer formed at the interfacial boundary regions comprise one or a combination of block copolymers, alternating copolymers, periodic copolymers, random copolymers, gradient copolymers, branched copolymers, or graft copolymers.

Generally, the methods set forth herein use an additive manufacturing system, e.g., a 2D or a 3D inkjet printer system, to form (print) at least portions of the polishing pads in a layer-by-layer process. Typically, each print layer is formed (printed) by sequentially depositing and at least partially curing droplets of desired pre-polymer compositions and/or pore-forming sacrificial material precursor compositions on a manufacturing support or a previously formed print layer. Beneficially, the additive manufacturing system and the methods set forth herein enable at least micron scale droplet placement control within each print layer (X-Y resolution) as well as micron scale (0.1 μm to 200 μm) control over the thickness (Z resolution) of each print layer. The micron scale X-Y and Z resolutions provided by the additive manufacturing systems and the methods set forth herein facilitate the formation of desirable and repeatable patterns of the different pore-feature density regions and material domains, each region and/or domain having unique properties and attributes. Thus, in some embodiments, the additive manufacturing methods used to from the polishing pads also impart one or more distinctive structural characteristics of the polishing pads formed therefrom.

Figure 3A:
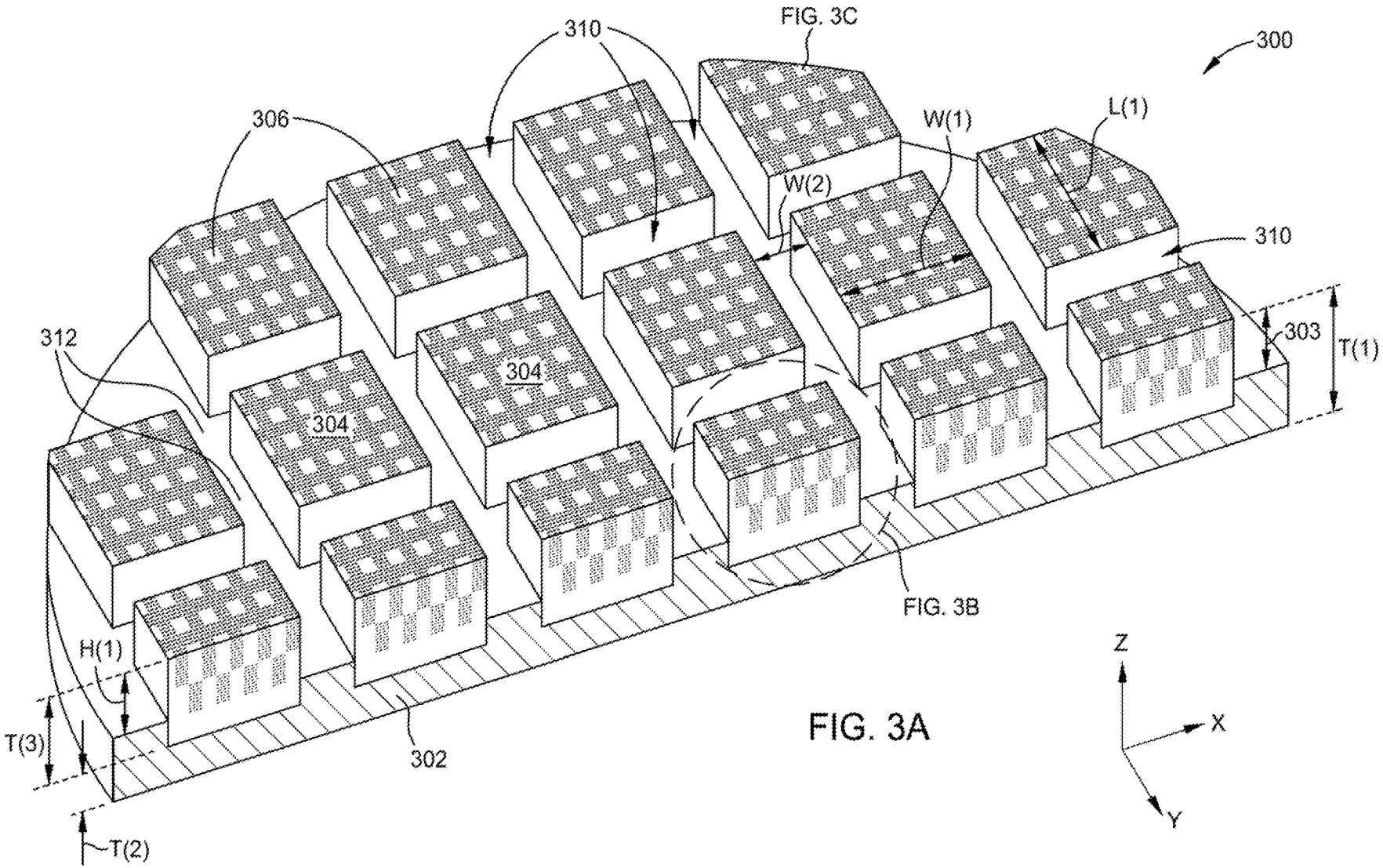
FIG. 3A is a schematic perspective sectional view of a polishing pad featuring spatially arranged pore-feature density regions, according to one embodiment.
Figure 3B:
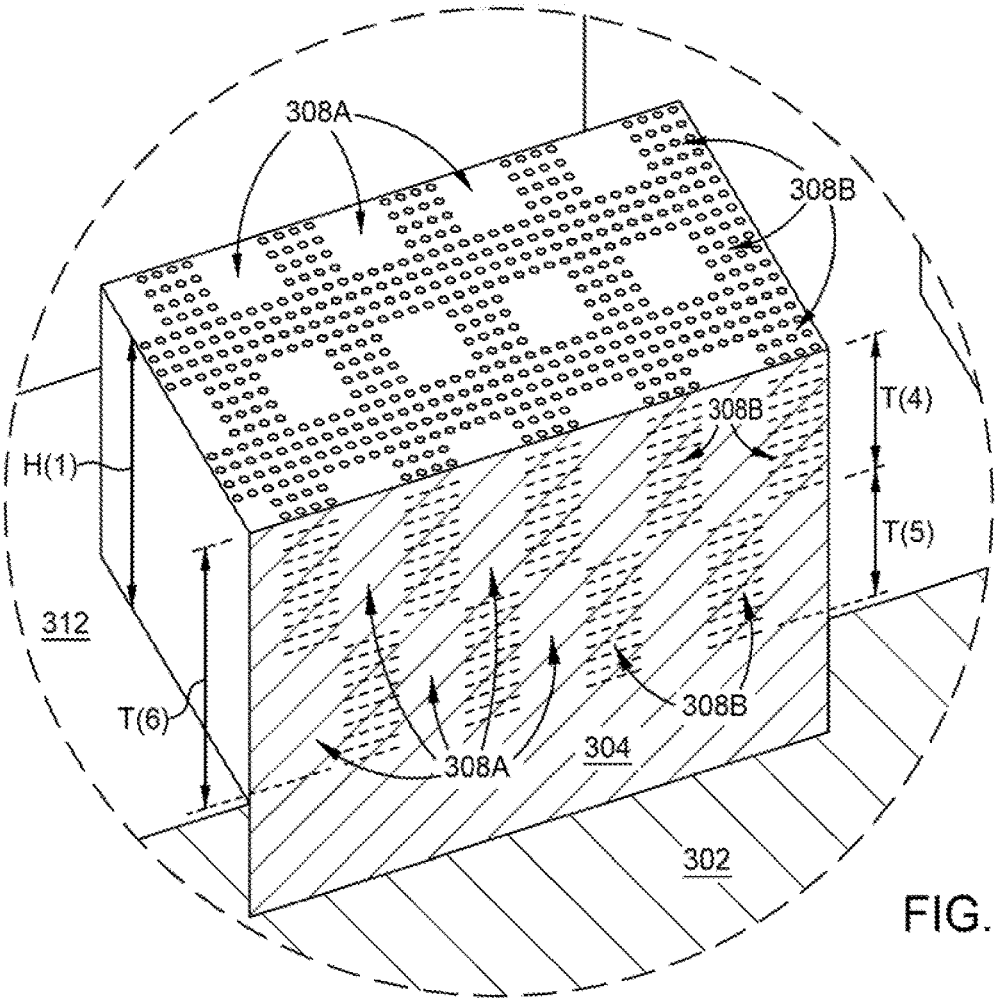
FIG. 3B is a close-up view of a portion of FIG. 3A.
Figure 3C:
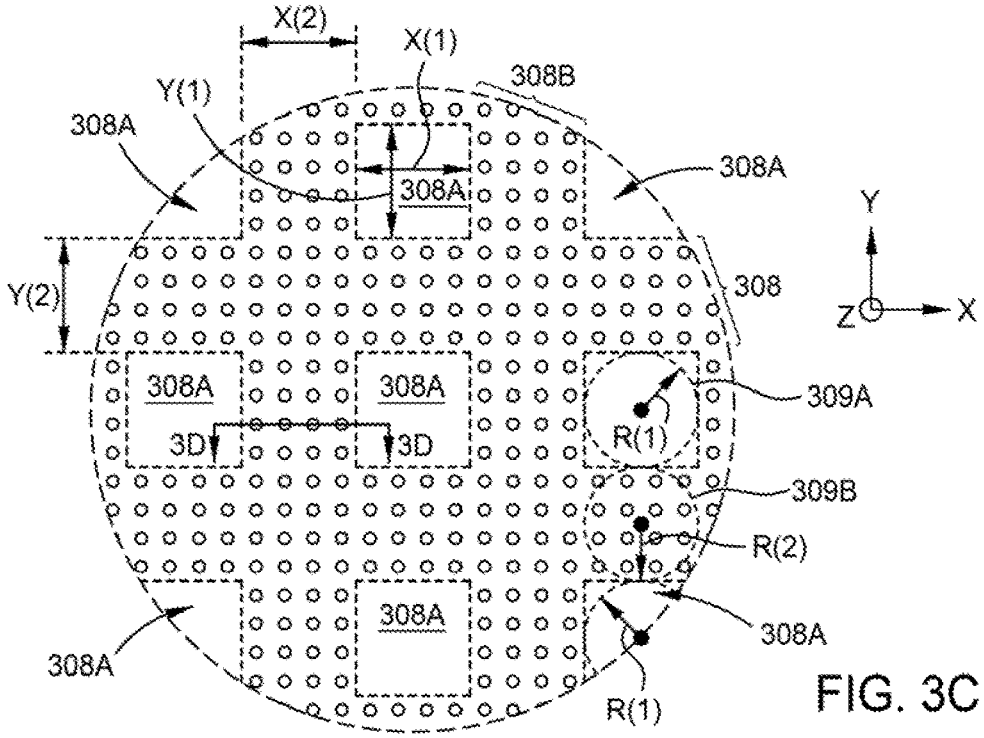
FIG. 3C is a close-up top down view of a portion of the polishing pad described in FIG. 3A.
Figure 3D:
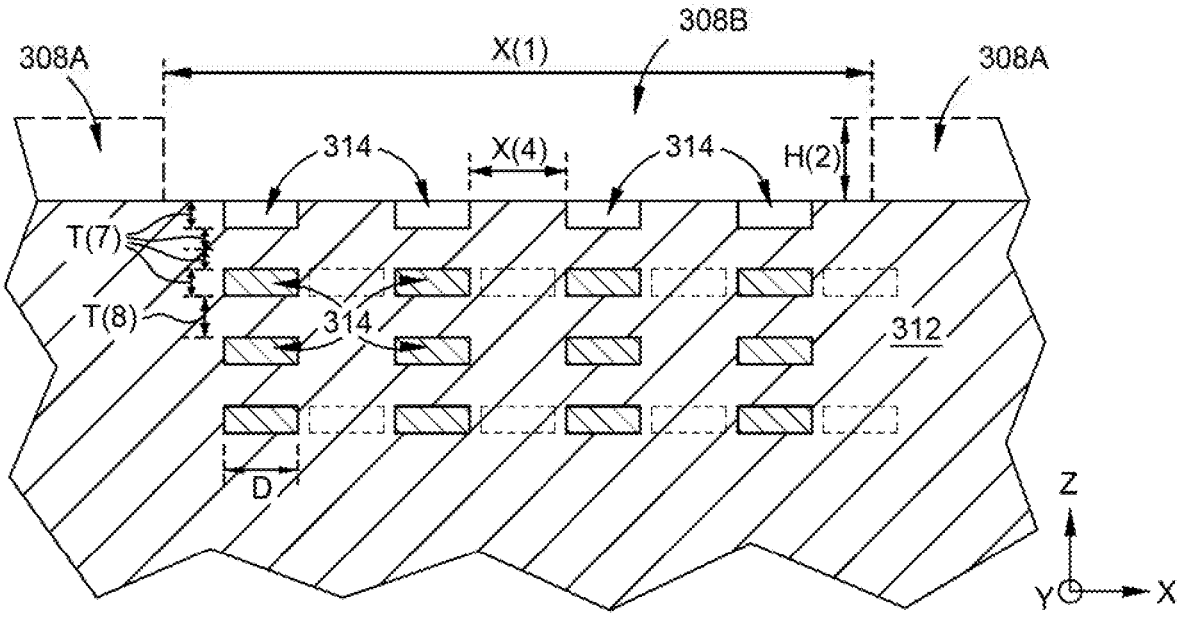
FIG. 3D is a sectional view of a portion of FIG. 3C, taken along line 3D-3D.

FIG. 3A is a schematic perspective sectional view of a polishing pad 300, according to one embodiment, which may be formed using the methods set forth herein. FIG. 3B is a close-up view of a portion of FIG. 3A. FIG. 3C is a top-down view of a portion of the polishing pad 300 in FIG. 3A. FIG. 3D is a sectional view of a portion of FIG. 3C taken along line 3D-3D. Here, the polishing pad 300 includes a foundation layer 302 and a polishing layer 303 disposed on the foundation layer 302 and integrally formed therewith using an additive manufacturing process. The additive manufacturing process allows for co-polymerization of different pre-polymer compositions used to respectively form the foundation layer 302 and the polishing layer 303, thus providing a continuous phase of polymer material across the interfacial boundary regions therebetween.

Here, the polishing layer 303 is formed of a plurality of polishing elements 304 that extend upwardly from the foundation layer 302 to form a polishing surface 306 comprising spatially arranged micro-regions of different pore-feature densities (308A, 308B). In this embodiment, the plurality of polishing elements 304 are spaced apart from one another to define a plurality of channels 310 therebetween. The plurality of channels 310 are disposed between adjacent ones of the plurality of polishing elements 304 and between a plane of the polishing surface 306 and an upward facing surface 311 of the foundation layer 302. The plurality of channels 310 facilitate the distribution of polishing fluids across the polishing pad 300 and to an interface between the polishing surface 306 and a material surface of a substrate to be polished thereon. The plurality of polishing elements 304 are supported in a thickness direction (Z direction) of the polishing pad 300 by a portion of the foundation layer 302. Thus, when a load is applied to the polishing surface 306 by a substrate urged thereagainst, the load will be transmitted through the polishing elements 304 and to the portion of the foundation layer 302 disposed therebeneath.

Here, the plurality of polishing elements 304 are formed to have a substantially rectangular shape (square as shown) when viewed from top down and are arranged so that the plurality of channels 310 defined therebetween form an X-Y grid pattern. Alternate shapes and/or arrangements of polishing elements that may be used for the polishing elements 304, and the channels 310 defined therefrom, are illustrated in FIG. 4A and FIGS. 6A-6F. In some embodiments, the shapes, dimensions, and/or arrangements of the polishing elements 304, and/or the channels 310 disposed therebetween, are varied across the polishing pad 300 to tune hardness, mechanical strength, fluid transport characteristics, and/or other desirable properties thereof. In some embodiments, the polishing layer 303 may not include discrete polishing elements and/or channels 310 defined between polishing surfaces of adjacent polishing elements may not extend through to the foundation layer 302.

Here, the polishing pad 300 has a first thickness T(1) measured between a platen mounting surface and the polishing surface 306 of between about 5 mm and about 30 mm. The foundation layer 302 has a second thickness T(2) of between about ⅓ to about ⅔ of the first thickness T(1). The polishing elements 304 have a third thickness T(3) that is between about ⅓ and about ⅔ of the first thickness T(1). As shown, at least a portion of the polishing elements 304 are extend through an X-Y plane of the upward facing surface 311 of the foundation layer 302 to a location inwardly of the foundation layer 302 and the remaining portion of the polishing elements 304 extend upwardly or outwardly of the foundation layer 302 by a height H(1) from the X-Y plane of the upward facing surface 311 of the foundation layer 302. The height H(1) of the polishing elements 304 defines a depth of the channels 310 interposed therebetween. In some embodiments, the height H(1) of the polishing elements 304, and thus the depth of the channels 310, is about ½ of the first thickness T(1) or less. In some embodiments, a height H(1) of the polishing elements 304, and thus the depth of the channels 310, is about 15 mm or less, such as about 10 mm or less, about 5 mm or less, or between about 100 μm and about 5 mm.

Here, at least one lateral dimension of the polishing elements 304, e.g., one or both of W(1) and L(1) when viewed from above, is between about 5 mm and about 30 mm, such as between about 5 mm and about 20 mm, or between about 5 mm and about 15 mm. The upper surfaces of the polishing elements 304 are parallel to the X-Y plane and form a polishing surface 306, which together form the total polishing surface of the polishing pad 300. Sidewalls of the polishing elements 304 are substantially vertical (orthogonal to the X-Y plane), such as within about 20° of vertical, or within 10° of vertical. Individual ones of the plurality of polishing elements 304 are spaced apart from one another in the X-Y plane by a width W(2) of the individual channels 310 defined therebetween. Here, the width W(2) of the individual channels 310 is more than about 100 μm and less than about 5 mm, such as less than about 4 mm, less than about 3 mm, less than about 2 mm, or less than about 1 mm. In some embodiments, one or both of the lateral dimensions W(1) and L(1) of the polishing elements 304 and/or the width W(2) of the individual channels 310 vary across a radius of the polishing pad 300 to allow fine tuning of the polishing performance thereof.

In embodiments herein, at least portions of the polishing layer 303, and/or the individual polishing elements 304 thereof, feature micro-regions of at least two different pore-feature densities. Here, each polishing element 304 features a plurality of individual micro-regions having a relatively low pore-feature density, e.g., the plurality of first pore-feature density regions 308A, which are spaced apart from one another by portions of a continuous matrix of micro-regions having a relatively high pore-feature density, e.g., the continuous matrix of second pore-feature density regions 308B. Thus, the first pore-feature density regions 308A within a polishing element 304 collectively have a smaller surface area than the polishing surface 306 defined by the lateral boundaries of the polishing element 304. In some embodiments, such as in embodiments where the polishing layer 303 does not include the individual polishing elements 304, a plurality of spaced apart first pore-feature density regions 308A will typically be found within a 30 mm×30 mm sample of the polishing surface 306 (when viewed from above).

Here, the plurality of second pore-feature density regions 308B are disposed in a continuous matrix (when viewed from above) to form an X-Y grid of relatively high pore-feature density polishing material. Individual ones of the plurality of first pore-feature density regions 308A are bounded by the continuous matrix of second pore-feature density regions 308B and are spaced apart from one another to form discrete islands or micro-pads of relatively low pore-feature density polishing material in the polishing surface 306. Here, individual ones of the first pore-feature density regions 308A have a generally square shape having a first lateral dimension X(1) and a second lateral dimension Y(1) when viewed from top down. The first pore-feature density regions 308A are spaced apart from one another by first distance X(2) or a second distance Y(2) both of which correspond to lateral dimensions of the portions of the second pore-feature density regions 308B interposed therebetween.

In other embodiments, the micro-regions of different pore-feature density may be arranged so that of individual ones of the plurality of first pore-feature density regions 308A have a non-square shape when viewed from top down, such as a rectangular or other quadrilateral shape, or a circular, elliptical, annular, triangular, polygonal, non-geometric shape, or a composite shape formed therefrom. In those embodiments, an individual first pore-feature density region 308A comprises the first and second lateral dimensions X(1) and Y(1), respectively, and at a least portion thereof includes a continuous area which is defined by a circle 309A having a radius R(1).

Herein, X(1), Y(1), and R(1) are measured parallel to the polishing surface 306, and thus parallel to a supporting surface of the polishing pad 300, i.e., in the X-Y plane. The second lateral dimension Y(1) is measured in a direction that is orthogonal the first lateral dimension X(1). In some embodiments, each of first and second lateral dimensions X(1), Y(1) span a distance of at least about 100 μm, such as at least about 200 μm, at least about 300 μm, at least about 400 μm, or at least about 500 μm. In some embodiments, the radius R(1) of the circle 309A defining at least a portion of each of the individual first pore-feature density regions 308A is at least about 100 μm, such as at least about 200 μm, at least about 250 μm, or at least about 300 μm.

In some embodiments, at least one of the first lateral dimension X(1), the second lateral dimension Y(1), and/or the radius R(1) span a distance in the range from about 100 μm to about 10 mm, such from about 100 μm to about 5 mm. In some embodiments, at least one of the one of the first lateral dimension X(1) and the second lateral dimension Y(1) spans a distance of about 100 μm or more, such as about 200 μm or more, about 300 μm or more, about 400 μm or more, about 500 μm or more, about 600 μm or more, about 700 μm or more, about 800 μm or more, about 900 μm or more, or about 1 mm or more.

In this embodiment, the individual ones of the plurality of first pore-feature density regions 308A are spaced apart from one another by at least portions of the continuous matrix of second pore-feature density regions 308B interposed therebetween. Here, the portions of the plurality of second pore-feature density regions 308B disposed between individual ones of the plurality of first pore-feature density regions 308A span a first distance X(2) or a second distance Y(2). Typically, at least one of distances X(2) or Y(2), and thus a corresponding distance between individual ones of the plurality of first pore-feature density regions 308A, are in the range from about 100 μm to about 10 mm, such as about 100 μm to about 5 mm. In some embodiments, one or both of the first and second distances X(2), Y(2) are at least about 100 μm, such as at least about 200 μm, at least about 300 μm, at least about 400 μm, or at least about 500 μm.

Figure 4A:
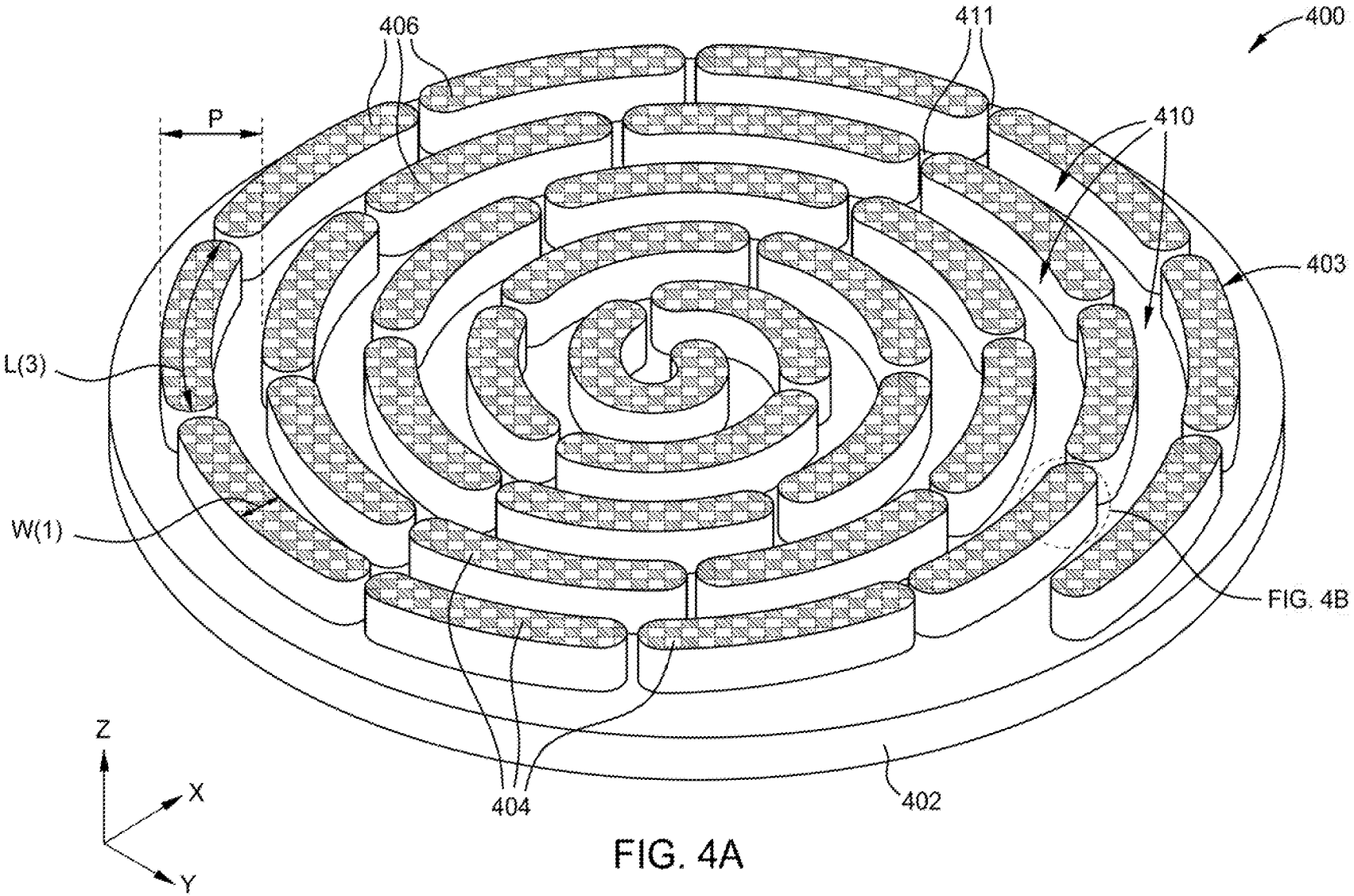
FIG. 4A is a schematic perspective view of a polishing pad featuring spatially arranged pore-feature density regions, according to another embodiment.
Figure 4B:
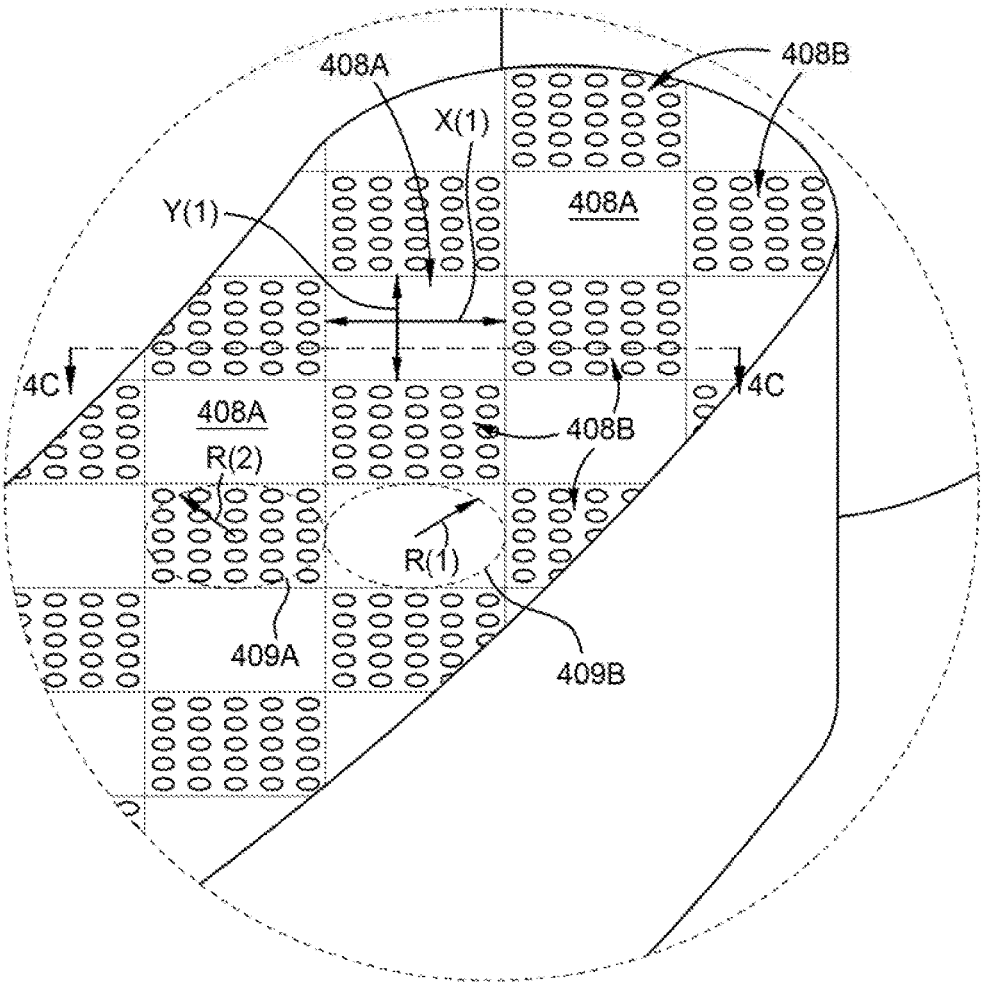
FIG. 4B is a close-view of a portion of FIG. 4A.

In some embodiments, at least a portion of the second pore-feature density regions 308B adjoining and disposed between individual ones of the first pore-feature density regions 308A includes a continuous area defined by a circle 309B having a radius R(2). In some embodiments, the radius R(2) is at least about 100 μm, such as at least about 200 μm, at least about 250 μm, or at least about 300 μm. The spatially arrangement of the first pore-feature density regions 308A and the second pore-feature density regions 308B illustrated in FIGS. 3A-3B may be used in combination with any of the polishing pads described herein to provide micro-regions of different pore-feature density across a polishing surface thereof. Alternate arrangements of micro-regions of different pore-feature density are illustrated in FIGS. 4A-4B.

Typically, the pore-feature density in a micro-region having relatively high pore-feature density, e.g., the second pore-feature density regions 308B, is in a range from about 2% to about 75%, such as about 2% or more, about 5% or more, about 10% or more, about 20% or more, about 30% or more, about 40% or more, about 50% or more, or about 60% or more. The pore-feature density in a micro-region having a relatively low pore-feature density, e.g., the first pore-feature density regions 308A, is less than that of micro-regions of relatively high pore-feature density adjacent thereto and interposed therebetween. In some embodiments, the pore-feature density in a region having relatively low pore-feature density, e.g., first pore-feature density regions 308A, is about ⅔ or less than that of an adjoining high pore-feature density regions, such as about ½ or less, or ⅓ or less. In some embodiments, the relatively low pore-feature density region is substantially free of pore-features, e.g., a pore-feature density of about 2% or less, such as 1% or less.

In FIGS. 3A-3D, the relatively low pore-feature density regions, e.g., the first pore-feature density regions 308A, form a total area of the polishing surface 306 that is less than that occupied by the relatively high pore-feature density regions, e.g., the second pore-feature density regions. In some embodiments, a ratio of the total surface area formed by the relatively low pore-feature density regions to a total surface area formed by the relatively high pore-feature density regions is less than about 1:1, such as less than about 1:2, less than about 1:3, or less than about 1:4. In other embodiments, the low pore-feature density regions may comprise a greater total surface area that of the relatively high pore-feature density regions.

Here, the polishing surfaces formed from the first and second pore-feature density regions 308A, 304B respectively are substantially coplanar with the different pore-feature density regions disposed adjacent thereto in the free state, i.e., when not urged against a surface to be polished. In other embodiments, the surfaces of the first pore-feature density regions 308A may be formed to extend above the surfaces of adjacent second pore-feature density regions 308B by a height H(2) (surfaces of first pore-feature density regions extending above surfaces of adjacent second pore-feature density regions are shown in phantom in FIGS. 3C-3D). Here, the height H(2) is more than about 25 μm, such as more than about 50 μm, more than about 75 μm, more than about 100 μm, more than about 125 μm, more than about 150 μm, or more than about 175 μm. In some embodiments, the height H(2) is between about 25 μm and about 200 μm, such as between about 50 μm and about 200 μm.

In other embodiments, the surfaces of the relatively high pore-feature density regions, e.g., the second pore-feature density regions 308B are formed to extend above the surface of adjacent low pore-feature density regions, e.g., the first pore-feature density regions. In those embodiments, a height difference between the surfaces of adjacent different pore-feature density regions is typically between about 25 μm and about 200 μm, such as between about 25 μm, and about 150 μm, or between about 50 μm and about 150 μm. By adjusting a height difference between the surfaces of regions of different pore-feature density the contact area, and thus the point-density distribution, between the polishing pad and a substrate area can be fined tuned thus enabling fine-tuning of local planarization and surface finish results. In some embodiments, the height difference between the surfaces of regions of different pore-feature density may be varied across the surface of the polishing pad.

Typically, the second pore-feature density regions 308B extend inwardly of the polishing surface 306 in the Z direction by at least a thickness T(4) which may be the same as either the height H or the thickness T(3) of the polishing element 304 or may be a fraction thereof (as shown). For example, in some embodiments, the second pore-feature density regions 308B extend below the polishing surface by a thickness T(4) that is 90% or less of the thickness T(3), such as about 80% or less, about 70% or less, about 60% or less, or about 50% or less. In some embodiments, the second pore-feature density regions 308B may extend by a thickness T(4) that is about 90% or less of the height H of the polishing element 304, such as about 80% or less, about 70% or less, about 60% or less, or about 50% or less. In some embodiments, second pore-feature density regions 308B are disposed in a staggered arrangement in the Z direction, e.g., the second pore-feature density regions 308B in thickness T(5) portion of the pore-features 314 which are offset in the X-Y directions from the pore-feature density regions 308 disposed in the thickness T(4) portion disposed thereabove. Alternating regions of different pore-feature density in the Z-direction enables fine-tuning of the material properties, e.g., the local or bulk compliance of the polishing elements 304 and/or the polishing layer 303 formed therefrom.

The plurality of pore-features 314 used to form the relatively high pore-feature density regions herein may be disposed in any desired vertical arrangement when viewed in cross-section. For example, in FIG. 3D, the plurality of pore-features 314 are vertically disposed in columnar arrangements (four columns shown) where the pore-features 314 in each of the columns are in substantial vertical alignment. In some embodiments, such as shown in FIG. 3A, groups of rows of pore-features 314 in the depth direction of the polishing elements 034 may be offset in one or both of X-Y directions to provide corresponding second pore-feature density regions below the polishing surface that are vertically staggered with respect to the second pore-feature density regions disposed thereabove. In some embodiments, the pore-features 314 may be vertically disposed in one or more staggered columnar arrangements where individual rows of pore-features 314 (e.g, the rows of pore-features 314 shown in phantom in FIG. 3D) are offset in one or both of the X-Y directions with respect to a row of pore-features 314 that is disposed thereabove and/or therebelow. The orientation of the pore-features 314 in the staggered pore-feature density regions shown in FIG. 3A and/or the staggered columnar arrangements shown in phantom in FIG. 3D can be advantageously used to adjust the compliance of the polishing material with respect to a direction of the load exerted by a substrate that is being polished thereon. Thus, in one example, the staggered pore-feature density regions and/or staggered columnar arrangement of individual pore-features within pore-feature density region may be advantageously used to adjust and/or control the polishing planarization performance of a polishing pad formed therefrom.

In some embodiments, the individual pore-features 314 used to form the relatively high pore-feature density regions have a height of about 50 μm or less, such as about 40 μm or less, about 30 μm or less, or about 20 μm or less. Typically, the individual pore-features 314 are formed to have a diameter D (measured in an X-Y plane) of about 500 μm or less, such as about 400 μm or less, about 300 μm or less, about 200 μm or less, or about 150 μm or less and about 5 μm or more, such as about 10 μm or more, about 25 μm or more, or about 50 μm or more. In some embodiments, the mean diameter D of the individual pore-features 314 is between about 50 μm and about 250 μm, such as between about 50 μm and about 200 μm, or between about 50 μm and about 150 μm. In some embodiments, the pore-features 314 are formed to be relatively shallow in the Z-direction compared to the diameter D thereof, for example, in some embodiments a height of the individual pore-features is about ⅔ or less than the diameter D thereof, such as about ½ or less, or about ⅓ or less.

In some embodiments, the pore-feature density may be further expressed as a number of pore-features within a 1 $mm^2$ area of an X-Y plane of the polishing pad 300, e.g., the polishing surface 306. For example, in some embodiments a mean diameter D of the individual pore-features 314 is between about 50 μm and about 250 μm and the relatively high pore-density regions include more than about 10 pore-features per $mm^2$ of polishing surface, such as more than about 50 pore-features/$mm^2$, more than about 100 pore-features/$mm^2$, more than about 200 pore-features/$mm^2$, more than about 300 pore-features/$mm^2$, for example, more than about 400 pore-features/$mm^2$.

Here, individual ones of the plurality of pore-features 314 are spaced apart in the vertical direction by one or more printed layers of the polymer material 312 formed therebetween. For example, if as shown in FIG. 3D individual printed layers of polymer material 312 have a thickness of T(7) and individual ones of the plurality of pore-features 314 are spaced apart in the vertical direction by two print layers, the total thickness T(8) of the polymer material in the thickness direction (Z direction) is about twice that of T(7). In one example, spacing between pore-features 314 in a vertical direction in polishing feature is about 40 μm. In this example, the 40 μm spacing can be formed by disposing two 20 μm print layers of the polymer material 312 between the printed layers that include the pore-features 314. Thus, as shown, the pore-features 314 form a substantially closed-celled structure once the sacrificial-material used to form the pore-features is removed therefrom.

In other embodiments one or more of the pore-features 314, or portions thereof, are not spaced apart from one or more of the pore-features 314 adjacent thereto and thus form a more open-celled structure once the sacrificial-material is removed therefrom. Typically, the thickness T(7) of the one or more printed layers is about 5 μm or more, such as about 10 μm or more, 20 μm or more, 30 μm or more, 40 μm or more, or 50 μm or more. The individual pore-features 314 may be formed within a corresponding single print layer (as shown) had thus have a height corresponding to the thickness T(8) of the print layer or may be formed within two or more adjacent print layers to provide a pore height corresponding to the cumulative thickness thereof. In some embodiments, the thickness T(7) is about 200 μm or less, such as about 100 μm or less, or about 50 μm or less. In some embodiments, the thickness T(7) is about 25 μm or less, such as about 10 μm or less, or about 5 μm or less.

Here, the first and second pore-feature density regions 308A-B are formed of a continuous polymer phase of material 312 having a relatively high storage modules E', i.e., a hard pad material, and a generally homogenous material composition therebetween. In other embodiments, the first and second pore-feature density regions 308A-B are formed of different pre-polymer compositions, or different ratios of at least two pre-polymer compositions, and thus comprise a difference from one another in one or more material properties. For example, in some embodiments, the storage modulus E' of materials used to form the continuous polymer phase of the first and the second pore-feature density regions 308A-B are different from one another and the difference may be measured using a suitable measurement method, such as nanoindentation. In some embodiments, the polymer material of the plurality of first pore-feature density regions 308A has a relatively medium or relativity high storage modulus E' and the polymer of the second pore-feature density regions 308B has a relativity low or relativity medium storage modulus E'. Characterizations as a low, medium, or high storage modulus E' material domains at a temperature of about 30° C. (E'30) are summarized in Table 1.

TABLE 1

| | Low Storage Modulus Compositions | Medium Modulus Compositions | High Modulus Compositions |
|---|---|---|---|
| E'30 | <100 MPa, (e.g., 1 MPa-100 MPa) | 100 MPa-500 MPa | >500 MPa (e.g., 500 MPa-3000 MPa) |

In some embodiments, a ratio of the storage modulus E'30 between the first pore-feature density regions 308A and second pore-feature density regions 308B is more than about 2:1, more than about 5:1, more than about 10:1, more than about 50:1, for example more than about 100:1. In some embodiments, the ratio of the storage modulus E'30 between the first pore-feature density regions 308A and the second pore-feature density regions 308B is more than about 500:1, for example more than about 1000:1.

Figure 3E:
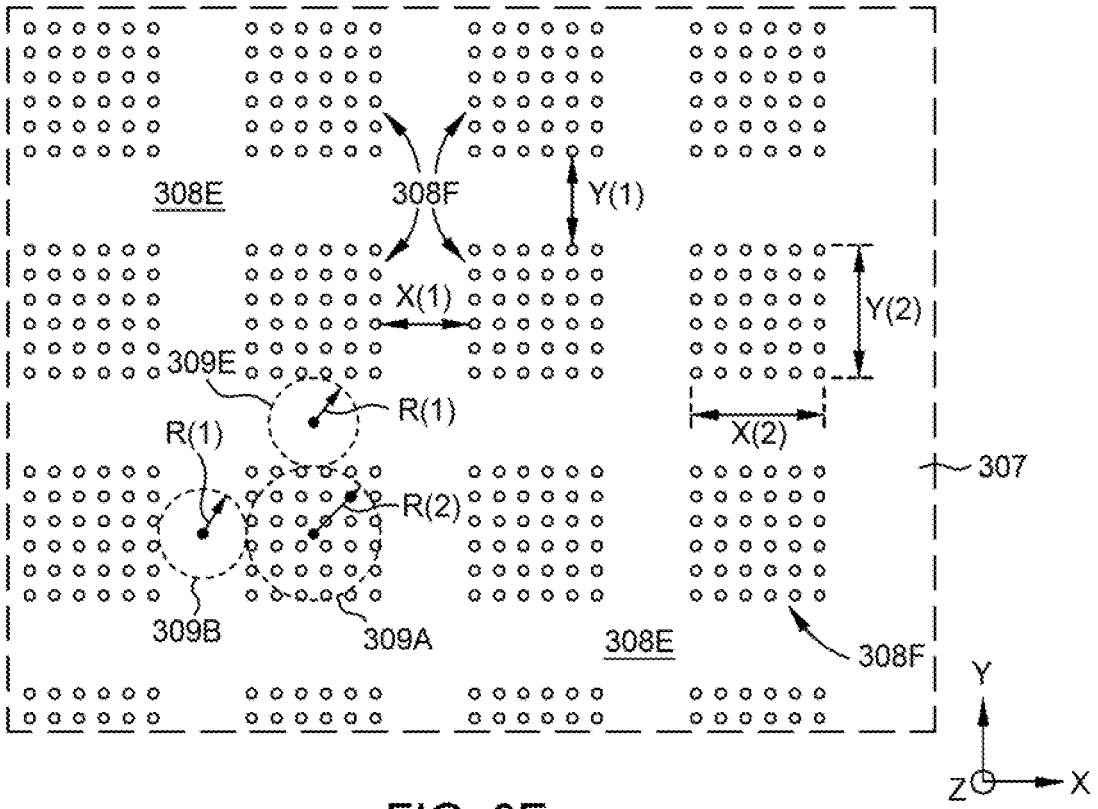
FIG. 3E is a schematic top down view of an alternate spatial arrangement of pore-feature density regions in a polishing surface, according to one embodiment.

FIG. 3E is a top down view of a spatial arrangement of different pore-feature density regions, according to one embodiment, which may be used in place of the spatial arrangements of different pore-feature density regions in any of the polishing elements and/or polishing layers described herein. Here, the different pore-feature density regions comprise a plurality of relatively low pore-feature density regions, here the first pore-feature density regions 308E, disposed in a continuous matrix to from an X-Y grid (when viewed from above) and a plurality of second pore-feature density regions 308F interposed therebetween. Here, the second pore-feature density regions 308F form discrete islands of relatively high pore-feature density polishing material in the polishing surface 306, which are spaced apart from one another by at least portions of the first pore-feature density regions 308E. The second pore-feature density regions 308F have lateral dimensions of X(2) and Y(2) which, here, are in the range of the distances X(2) and Y(2) described above for the second pore-feature density regions 308B. Individual ones of the second pore-feature density regions 308F are spaced apart from one another by a first distance X(1) or a second distance Y(1)) both of which correspond to lateral dimensions of the portions of the first pore-feature density regions 308E interposed therebetween. Here, the first distance X(1) and the second distance Y(1) are in the range of the lateral dimensions X(1) and Y(1) described above for the first pore-feature density regions 308A. In this embodiment, the relatively high pore-feature density regions are isolated from one another in the X-Y plane as opposed to the opposite, which is shown in FIGS. 3A-3D.

As shown, individual ones of the second pore-feature density regions 308F have a generally square shape when viewed from top down. In other embodiments, individual ones of the second pore-feature density regions 308F may have any other desired shape when viewed from top down, such as such as a rectangular or other quadrilateral shape, or a circular, elliptical, annular, triangular, polygonal, non-geometric shape, or a composite shape formed therefrom. In those embodiments, at least a portion of the first pore-feature density regions 308E adjoining and disposed between individual ones of the second pore-feature density regions 308F includes a continuous area defined by a circle 309E having the radius R(1). Typically, in those embodiments, the individual second pore-feature density regions 308F t comprises the first and second lateral dimensions X(2) and Y(2), respectively, and at a least portion thereof includes a continuous area which is defined by a circle 309F having the radius R(2).

In other embodiments, the different pore-feature density regions in any of the polishing pads described herein are disposed in an interlocking or interdigitated pattern (when viewed from above) so that neither the relatively low or relative high pore-feature density regions form discrete islands. In those embodiments, at least individual portions of the relatively low pore-feature density regions having the lateral dimensions X(1), Y(1), and/or at least the radius R(1) are separated from one another by adjoining individual portions of relatively high pore-feature density regions having the lateral dimensions X(2), Y(2), and/or at least the radius R(2).

In other embodiments, the different pore-feature density regions may form one or more spiral shapes or may form a plurality of concentric circles within the polishing surface of the individual polishing elements. In some embodiments, the different pore-feature density regions may form one or more spiral shapes or a plurality of concentric circles across the polishing surface. In those embodiments, the center of the one or more spiral shapes and/or concentric circles may be proximate to, or offset from, the center of the polishing surface. Typically, in embodiments where the different pore-feature density regions form spiral shapes or concentric circles a lateral dimension each of the different pore-feature density regions measured along a radius of the spiral or concentric circle will be the same as the lateral dimensions X(1), Y(1) and X(2), Y(2) described above.

Figure 4C:
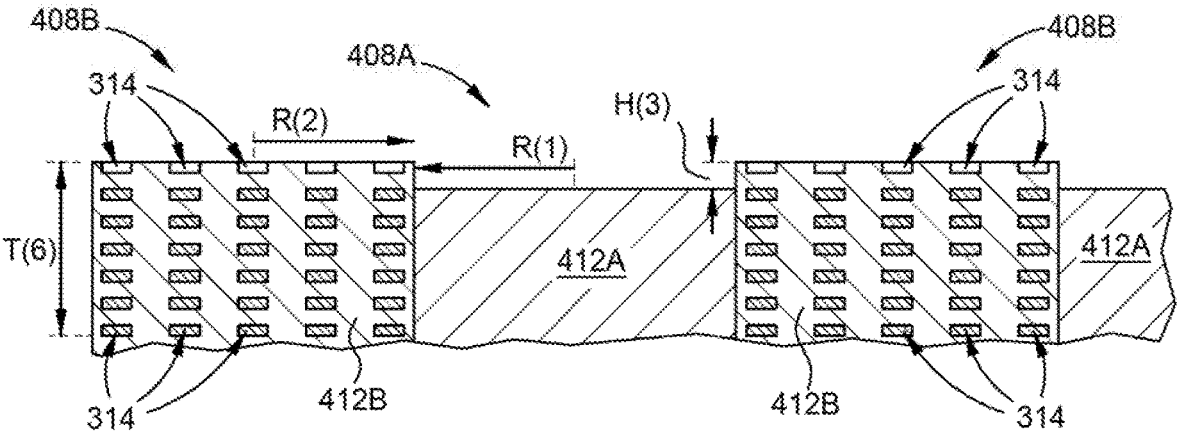
FIG. 4C is a sectional view of a portion of FIG. 4B, taken along line 4C-4C.

FIGS. 4A-4C schematically illustrate a polishing pad 400 featuring alternate shapes for the polishing elements 404 formed thereon and alternate arrangements of the different pore-feature density regions formed in the polishing surface 406 thereof, according to one embodiment. FIG. 4A is a schematic perspective view of the polishing pad 400. FIG. 4B is a close-up view of a portion of FIG. 4A. FIG. 4C is a sectional view of a portion of FIG. 4B taken along line 4C-4C. Features of the polishing pad 400 may be incorporated or be combined with any of the features of the polishing pad 300 described above.

Here, the polishing pad 400 includes a foundation layer 402 and a polishing layer 403 disposed on the foundation layer 402 and integrally formed therewith to provide a continuous phase of polymer material across the interfacial boundary regions therebetween. The polishing layer 403 is formed of a plurality of discrete polishing elements 404 disposed on or partially within the foundation layer 402 and extending upwardly from an upward facing surface 411 thereof to define one or more channels 410 disposed between individual ones of the plurality of polishing elements 404. Here, the plurality of polishing elements 404 are arranged to form corresponding segments of a spiral pattern. The spiral pattern extends from an inner radius of the polishing pad 400 to an outer radius proximate to the circumference of the polishing pad 400. Here, individual ones of the plurality of polishing elements have an arc length L(2) of between about 2 mm and about 200 mm and a width W(1) of between the about 200 μm and about 10 mm, such as between about 1 mm and about 5 mm. A pitch P between the maximum radius sidewalls of radially adjacent polishing elements 404 is typically between about 0.5 mm and about 10 mm, such as between about 0.5 mm and about 10 mm. In some embodiments, one or both of the arc length L(2), the width W(1), and the pitch P vary across a radius of the polishing pad 400 to define regions of different localized polishing performance.

In this embodiment, the polishing elements 404 are formed of a plurality of first pore-feature density regions 408A having a relatively low pore-feature density and a plurality of second pore-feature density regions 408B having a relatively high pore-feature density. Here, the first pore-feature density regions 408A and the second pore-feature density regions 408B are formed from different pre-polymer compositions, or different ratios of at least two different pre-polymer compositions, to provide corresponding first and second material domains 412A and 412B each having unique material properties. The first and second material domains 412A and 412B form a continuous polymer phase of polishing pad material across the adjoining locations therebetween, i.e., the interfacial boundary regions therebetween.

In some embodiments, as shown in FIG. 4C, the storage modulus E' of materials forming the first and second material domains 412A and 412B are different from one another and the difference may be measured using a suitable measurement method, such as a nano-indentation method. In some embodiments, the plurality of first material domains 412A are formed of a polymer material having a relatively medium or relativity high storage modulus E' (as described in Table 1) and the polymer of the second material domains 412B has a relativity low or relativity medium storage modulus E'.

In some embodiments, a ratio of the storage modulus E'30 between the first and second material domains 412A and 4128 is more than about 2:1, more than about 5:1, more than about 10:1, more than about 50:1, for example more than about 100:1. In some embodiments, the ratio of the storage modulus E'30 between the first and second material domains 412A and 412B is more than about 500:1, for example more than about 1000:1.

Here, the first and second pore-feature density regions 408A, 408B are arranged in a checkerboard pattern of alternating squares (when viewed from top down) and the polishing side surface of the first pore-feature density regions 408A are recessed from the surfaces of the adjoining second pore-feature density regions 408B by a height H(3) between about 25 μm and about 200 μm, such as between about 25 μm, and about 150 μm, or between about 50 μm and about 150 μm. In other embodiments, the shape and arrangement of the first and second pore-feature density region 408A, 408, and/or the heights H(2) (FIG. 3D) or H(3) therebetween, may comprise any combination of the other shapes and arrangements and respective height differences of the other spatially arranged pore-feature density regions and/or material domains described herein. In some embodiments, the polishing material of one or both of the foundation layer 302, 402, or polishing layer, 303, 403, including material domains 412A, 412B thereof, are formed of a continuous polymer phase of polishing material that features pluralities of spatially arranged material micro-domains, such as shown in FIGS. 5A-5D.

Figure 5A:
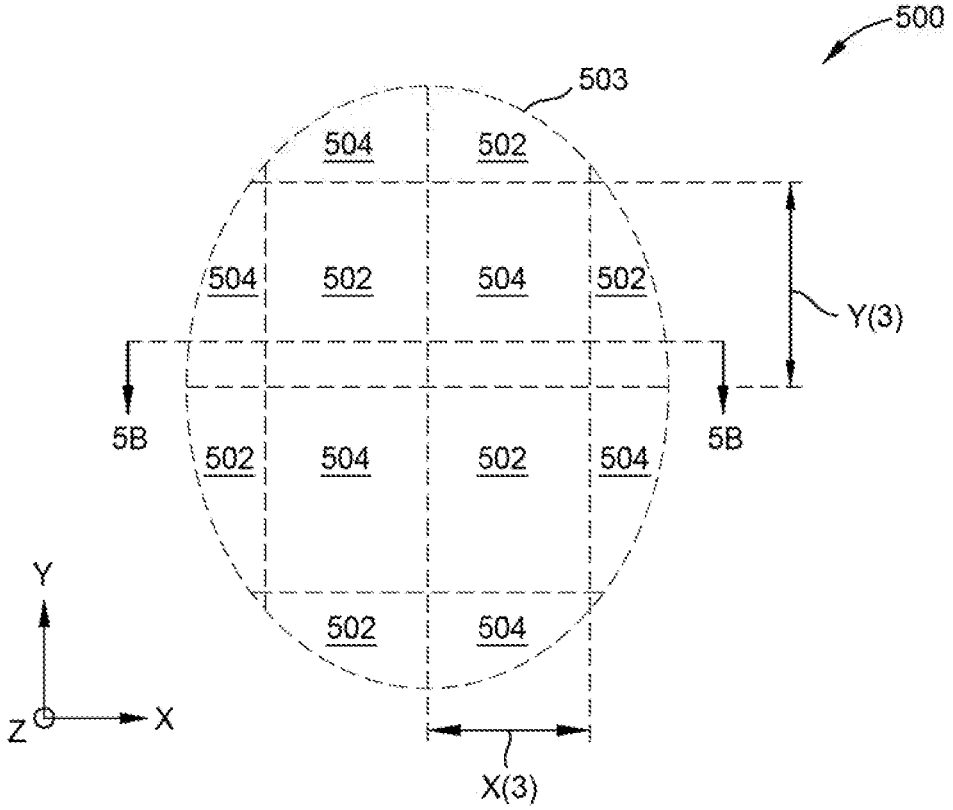
FIG. 5A is a schematic top down view of a portion of a polishing surface, formed according to embodiments described herein.
Figure 5B:
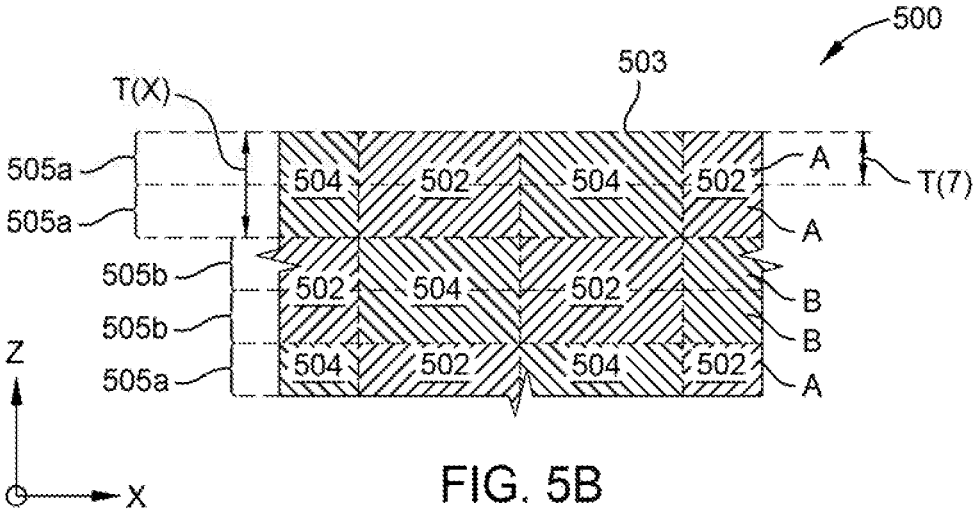
FIG. 5B is a schematic sectional view of FIG. 5A taken along the line 5B-5B.

FIG. 5A is a schematic top view of a portion of a polishing surface of a polishing pad 500 featuring spatially arranged material micro-domains 502, 504, formed according to embodiments described herein. FIG. 5B is a schematic sectional view of the portion of the polishing surface of FIG. 5A taken along the line 5B-5B. The portion of the polishing pad 500 shown in FIGS. 5A-5B features a continuous polymer phase of polishing pad material formed of a plurality of spatially arranged first material micro-domains 502 and a plurality of spatially arranged second material micro-domains 504. Here, the spatially arranged second material micro-domains 504 are interposed between the first material micro-domains 502 and, in some embodiments, positioned adjacent thereto.

Typically, the first material micro-domains 502 and the second material micro-domains 504 are formed of different pre-polymer compositions, such as the example pre-polymer compositions set forth in the description of FIG. 4A, and thus comprise a difference from one another in one or more material properties. For example, in some embodiments, the storage modulus E' of the first material micro-domains 502 and the second material micro-domains 504 are different from one another and the difference may be measured using a suitable measurement method, such as nanoindentation. In some embodiments, the plurality of second material micro-domains 504 have a relativity low or relativity medium storage modulus E' and the one or more first material micro-domains 502 have a relatively medium or relativity high storage modulus E', such as summarized in Table 1.

In some embodiments, a ratio of the storage modulus E'30 between either the first material micro-domains 502 and the second material micro-domains 504 or the second material micro-domains 504 and the first material micro-domains 502 is more than about 1:2, more than about 1:5, more than about 1:10, more than about 1:50, for example more than about 1:100. In some embodiments, the ratio of the storage modulus E'30 between the first material domain 502 and the second material domain 504 is more than about 1:500, for example more than 1:1000.

In FIG. 5A, the first and second material micro-domains 502, 504 are arranged in a first pattern A, which may be used to form a polishing surface 306, 406 of a polishing pad 300, 400, in an X-Y plane of the X and Y directions. As shown, the first and second material micro-domains 502, 504 have a rectangular sectional shape when viewed from above with a first lateral dimension X(3) and a second lateral dimension Y(3). The lateral dimensions X(3) and Y(3) are measured parallel to the polishing surface 306, 406, and thus parallel to the supporting surface, of the polishing pad 300, 400, i.e., in an X-Y plane. In other embodiments, the material micro-domains which may be used to form the continuous polymer phase polishing pad material may have any desired sectional shape when viewed from above, including irregular shapes.

In some embodiments, at least one lateral dimension (i.e., measured in the X-Y plane of the X and Y directions) of one or both of the first or second material micro-domains 502, 504 are less than about 10 mm, such as less than about 5 mm, less than about 1 mm, less than about 500 μm, less than about 300 μm, less than about 200 μm, less than about 150 μm, or between about 1 μm and about 150 μm. In some embodiments, the at least one lateral dimension X(3), Y(3) is more than about 1 μm, such as more than about 2.5 μm, more than about 5 μm, more than about 7 μm, more than about 10 μm, more than about 20 μm, more than about 30 μm, for example more than about 40 μm.

In some embodiments, one or more lateral dimensions of the first and second material micro-domains 502, 504 are varied across the polishing pad to tune the hardness, mechanical strength, fluid transport characteristics, or other desirable properties thereof. In the first pattern A the first and second material micro-domains 502, 504 are distributed in a side-by-side arrangement parallel to an X-Y plane. Here, individual ones of the plurality of first material micro-domains 502 are spaced apart by individual ones of the plurality of second material micro-domains 504 interposed therebetween. In some embodiments, individual ones of the first or second material micro-domains 502, 504 do not have a lateral dimension exceeding about 10 mm, exceeding about 5 mm, exceeding about 1 mm, exceeding about 500 μm, exceeding about 300 μm, exceeding about 200 μm, or exceeding about 150 μm.

Herein, the continuous polymer phase of polishing material is formed of a plurality of sequentially deposited and partially cured material precursor layers (print layers), such as the first print layers 505*a* and second print layers 505*b* shown in FIG. 5B. As shown the first and second material micro-domains 502 and 504 are spatially arranged laterally across each of the first and second print layers 505*a,b* in a first pattern A or a second pattern B respectively. Each of the print layers 505*a,b* are sequentially deposited and at least partially cured to form a continuous polymer phase of polishing material with the one or more print layers 505*a,b* disposed adjacent thereto. For example, when at least partially cured each of the print layers 505*a,b* form a continuous polymer phase with one or both of a previously or subsequently deposited and at least partially cured print layers 505*a,b* disposed there below or there above.

Typically, each of the print layers 505*a,b* are deposited to a layer thickness T(7). The first and second material micro-domains 502, 504 are formed of one or more sequentially formed layers 505*a,b* and a thickness T(X) of each material domain 502, 504 is typically a multiple, e.g., 1× or more, of the layer thickness T(7).

In some embodiments, the layer thickness T(7) is less than about 200 μm, such as less than about 100 μm, less than about 50 μm, less than about 10 μm, for example less than about 5 μm. In some embodiments, one or more of the material layers 505*a,b* is deposited to a layer thickness T(7) of between about 0.5 μm and about 200 μm, such as between about 1 μm and about 100 μm, between about 1 μm and about 50 μm, between about 1 μm and about 10 μm, or for example between about 1 μm and about 5 μm.

In some embodiments, the first material micro-domains 502 and the second material micro-domains 504 are alternately stacked one over the other in the Z-direction. For example, in some embodiments the plurality of the second material micro-domains 504 are distributed in a pattern in a Z plane of the polishing pad in a stacked arrangement with one or more or a plurality of first material micro-domains 502. In some of those embodiments, a thickness T(X) of one or more of the material micro-domains 502, 504 is less than about than about 10 mm, such as less than about 5 mm, less than about 1 mm, less than about 500 μm, less than about 300 μm, less than about 200 μm, less than about 150 μm, less than about 100 μm, less than 50 μm, less than about 25 μm, less than about 10 μm, or between about 1 μm and about 150 μm. In some embodiments, the thickness T(X) of one or more of the material micro-domains is more than about 1 μm, such as more than about 2.5 μm, more than about 5 μm, more than about 7 μm, or more than about 10 μm. In some embodiments, one or more of the material micro-domains 502, 504 extend from the supporting surface of the polishing pad to the polishing surface and thus the thickness T(X) of the material domain may be the same as the thickness of the polishing pad. In some embodiments, one or more of the material micro-domains 502, 504 extend a thickness of a 304, 404 or a foundation layer 302, 402.

Figure 5C:
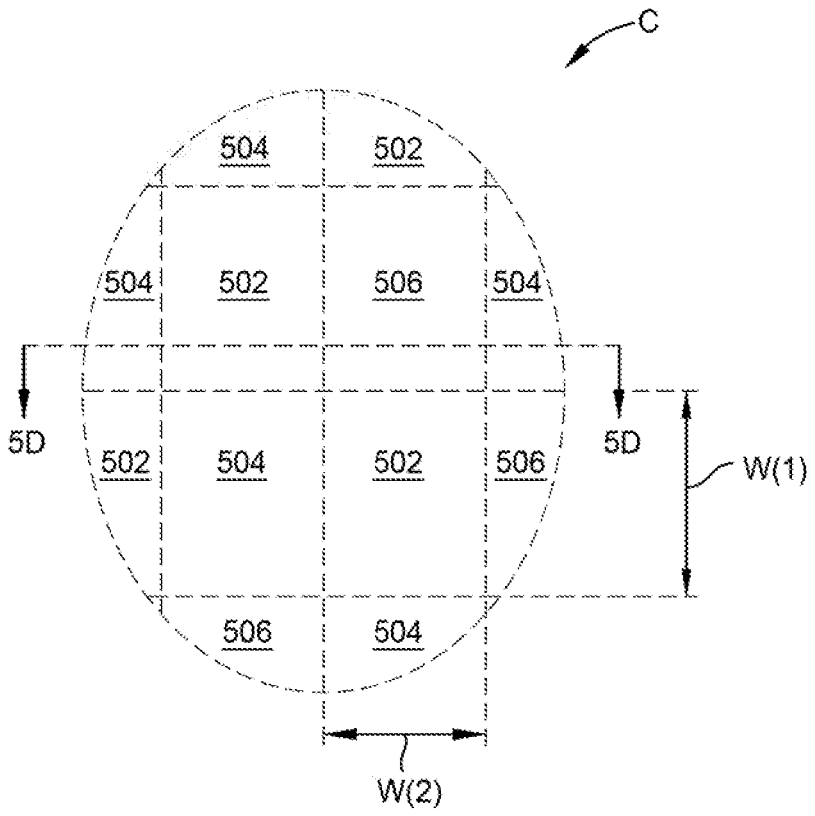
FIG. 5C is a schematic top down view of a portion of a polishing surface, formed according to embodiments described herein.
Figure 5D:
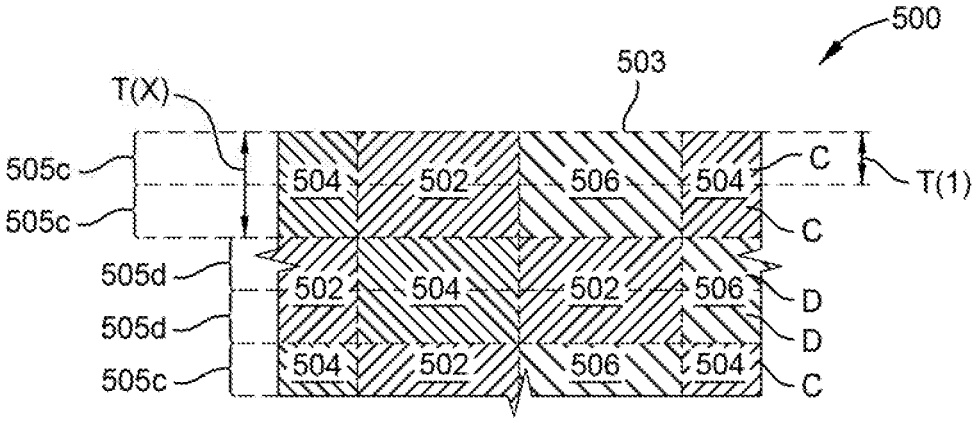
FIG. 5D is a schematic sectional view of FIG. 5C taken along the line 5C-5C.

FIG. 5C is a schematic close-up top view of a portion of a polishing pad material surface featuring a plurality of spatially arranged pore-forming features, according to some embodiments. FIG. 5D is a schematic sectional view of the portion of polishing pad shown in FIG. 5C taken along the line 5D-5D. Here, a continuous polymer phase of polishing material is formed of a plurality of sequentially deposited and partially cured materiel precursor layers (print layers), such as the third print layers 505*c* or the fourth print layers 505*d* shown in FIG. 5D. As shown, the plurality of first and second material micro-domains 502, 504 are disposed in a side-by-side arrangement parallel to the X-Y plane and the plurality of pore forming features 506 are interspersed within each of the third and fourth print layers 505*c,d* in a third pattern C or a forth pattern D respectively across the span of the print layer. The first and second material micro-domains 502, 504 form a continuous polymer phase of polishing material and the discontinuous plurality of pore-features 506 are interspersed between individual ones of the pluralities of spatially arranged material micro-domains 502, 504.

In some embodiments, the plurality of pore-features 506 have one or more lateral (X-Y) dimensions which are less than about 10 mm, such as less than about 5 mm, less than about 1 mm, less than about 500 μm, less than about 300 μm, less than about 200 μm, less than about 150 μm, less than about 100 μm, less than about 50 μm, less than about 25 μm, or for example less than about 10 μm. In some embodiments, the one or more lateral dimension of the pore-features 506 are more than about 1 μm, such as more than about 2.5 μm, more than about 5 μm, more than about 7 μm, more than about 10 μm, or more than about 25 μm. In some embodiments, the one or more lateral dimensions of the pore forming features 506 are varied across the polishing pad to tune the fluid transport characteristics or other desirable properties thereof.

Here, the pore forming features 506 have a thickness, such as the thickness T(X), which is typically a multiple, e.g., 1X or more, of a thickness T(1) of the each of the print layers 505*c,d*. For example, the thickness of the pore forming features within a print layer is typically the same as the thickness of the continuous polymer phase of polishing material disposed adjacent thereto. Thus, if the pore forming features laterally disposed within at least two sequentially deposited print layers are aligned or at least partially overlap in the Z-direction the thickness T(X) of the resulting pore forming feature will be at least the combined thickness of the at least two sequentially deposited print layers. In some embodiments, one or more of the pore forming features do not overlap with a pore-feature 506 in adjacent layer disposed there above or there below and thus has a thickness T(7). An exemplary additive manufacturing system which may be used to practice any one or a combination of the polishing pad manufacturing methods set forth herein is further described in FIG. 7A.

FIGS. 6A-6F are schematic plan views of various polishing element 604*a-f* shapes and/or arrangements which may be used in place of any of the other polishing element shapes and/or arrangements described herein. Here, each of the FIGS. 6A-6F include pixel charts having white regions (regions in white pixels) that represent the polishing elements 604*a-f* and black regions (regions in black pixels) that represent the foundation layer 402, as viewed from above. Spatially arranged pore-feature density regions, material domains, and/or material micro-domains (not shown in FIGS. 6A-6F) may comprise any one or combination of the embodiments set forth herein.

Figure 6A:
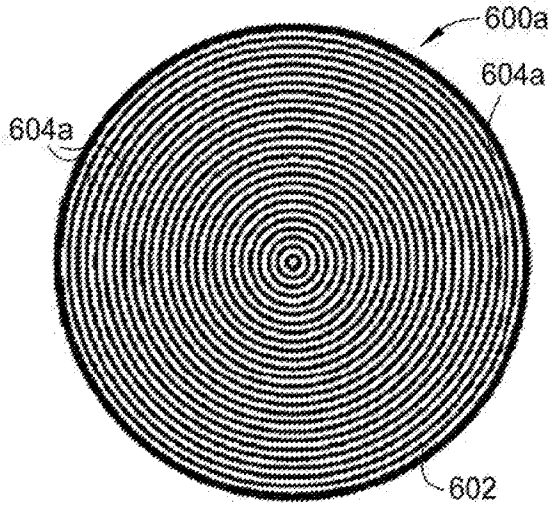
FIGS. 6A-6F are schematic plan views of various polishing element designs which may be used in place of the polishing element designs shown in FIGS. 3A and 4A.
Figure 6B:
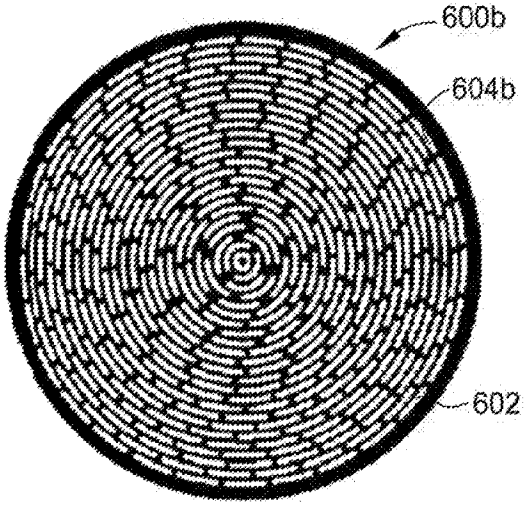
Figure 6C:
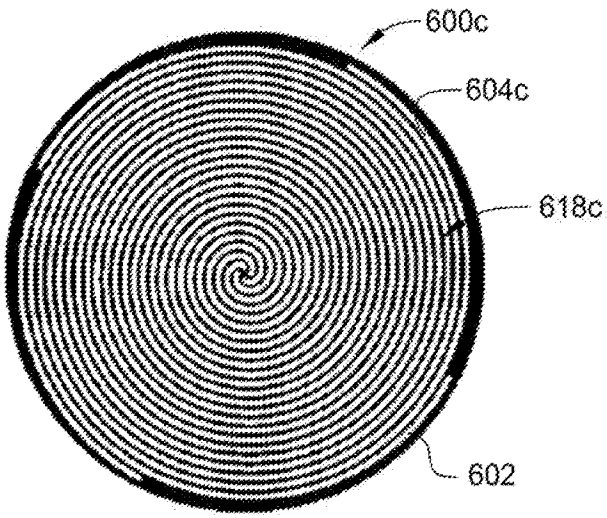
Figure 6D:
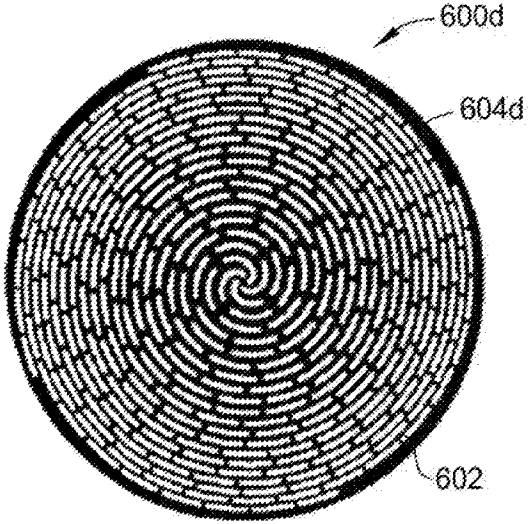

In FIG. 6A, the polishing elements 600*a* comprise a plurality of concentric annular rings. In FIG. 6B, the polishing elements 600*b* comprise a plurality of segments of concentric annular rings. In FIG. 6C, the polishing elements 604*c* form a plurality of spirals (four shown) extending from a center of the polishing pad 600*c* to an edge of the polishing pad 600*c* or proximate thereto. In FIG. 6D, a plurality of discontinuous polishing elements 604*d* are arranged in a spiral pattern on the foundation layer 602.

Figure 6E:
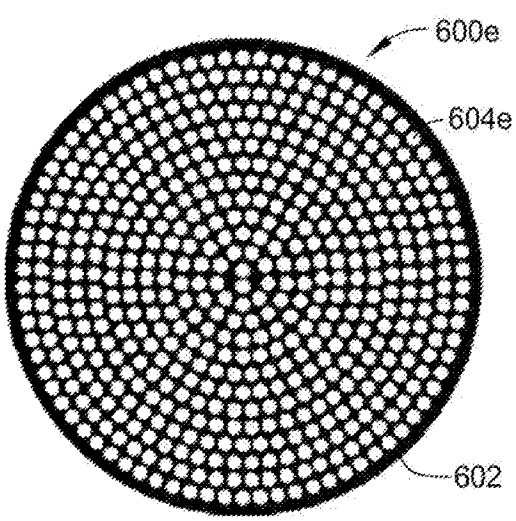
Figure 6F:
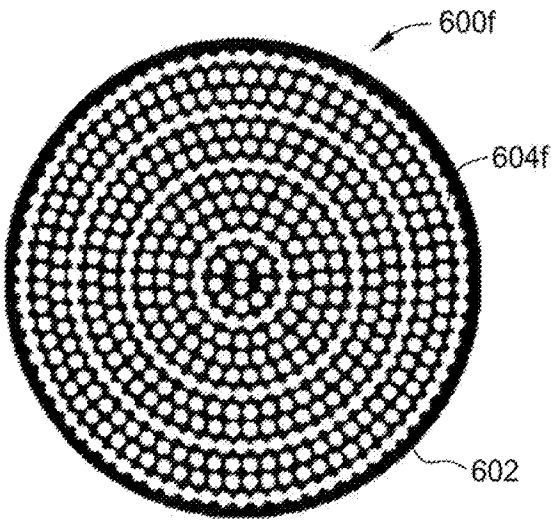

In FIG. 6E, each of the plurality of polishing elements 604*e* comprise a cylindrical post extending upwardly from the foundation layer 602. In other embodiments, the polishing elements 604*e* are of any suitable cross-sectional shape, for example columns with toroidal, partial toroidal (e.g., arc), oval, square, rectangular, triangular, polygonal, irregular shapes in a section cut generally parallel to the underside surface of the pad 600*e*, or combinations thereof. FIG. 6F illustrates a polishing pad 600*f* having a plurality of discrete polishing elements 604*f* extending upwardly from the foundation layer 602. The polishing pad 600*f* of FIG. 6F is similar to the polishing pad 600*e* except that some of the polishing elements 604*f* are connected to form one or more closed circles. The one or more closed circles create damns to retain polishing fluid during a CMP process.

Formulation and Material Examples

The pre-polymer compositions used to form the foundation and polishing layers described above each comprise a mixture of one or more of functional polymers, functional oligomers, functional monomers, reactive diluents, and photoinitiators.

Examples of suitable functional polymers which may be used to form one or both of the at least two pre-polymer compositions include multifunctional acrylates including di, tri, tetra, and higher functionality acrylates, such as 1,3,5-triacryloylhexahydro-1,3,5-triazine or trimethylolpropane triacrylate.

Examples of suitable functional oligomers which may be used to form one or both of the at least two pre-polymer compositions include monofunctional and multifunctional oligomers, acrylate oligomers, such as aliphatic urethane acrylate oligomers, aliphatic hexafunctional urethane acrylate oligomers, diacrylate, aliphatic hexafunctional acrylate oligomers, multifunctional urethane acrylate oligomers, aliphatic urethane diacrylate oligomers, aliphatic urethane acrylate oligomers, aliphatic polyester urethane diacrylate blends with aliphatic diacrylate oligomers, or combinations thereof, for example bisphenol-A ethoxylate diacrylate or polybutadiene diacrylate, tetrafunctional acrylated polyester oligomers, and aliphatic polyester based urethane diacrylate oligomers.

Examples of suitable monomers which may be used to from one or both of the at least two pre-polymer compositions include both mono-functional monomers and multi-functional monomers. Suitable mono-functional monomers include tetrahydrofurfuryl acrylate (e.g. SR285 from Sartomer®), tetrahydrofurfuryl methacrylate, vinyl caprolactam, isobornyl acrylate, isobornyl methacrylate, 2-phenoxyethyl acrylate, 2-phenoxyethyl methacrylate, 2-(2-ethoxyethoxy)ethyl acrylate, isooctyl acrylate, isodecyl acrylate, isodecyl methacrylate, lauryl acrylate, lauryl methacrylate, stearyl acrylate, stearyl methacrylate, cyclic trimethylolpropane formal acrylate, 2-[[(Butylamino) carbonyl] oxy]ethyl acrylate (e.g. Genomer 1122 from RAHN USA Corporation), 3,3,5-trimethylcyclohexane acrylate, or mono-functional methoxylated PEG (350) acrylate. Suitable multifunctional monomers include diacrylates or dimethacrylates of diols and polyether diols, such as propoxylated neopentyl glycol diacrylate, 1,6-hexanediol diacrylate, 1,6-hexanediol dimethacrylate, 1,3-butylene glycol diacrylate, 1,3-butylene glycol dimethacrylate 1,4-butanediol diacrylate, 1,4-butanediol dimethacrylate, alkoxylated aliphatic diacrylate (e.g., SR9209A from Sartomer®), diethylene glycol diacrylate, diethylene glycol dimethacrylate, dipropylene glycol diacrylate, tripropylene glycol diacrylate, triethylene glycol dimethacrylate, alkoxylated hexanediol diacrylates, or combinations thereof, for example SR562, SR563, SR564 from Sartomer®.

Typically, the reactive diluents used to form one or more of the pre-polymer compositions are least monofunctional, and undergo polymerization when exposed to free radicals, Lewis acids, and/or electromagnetic radiation. Examples of suitable reactive diluents include monoacrylate, 2-ethylhexyl acrylate, octyldecyl acrylate, cyclic trimethylolpropane formal acrylate, caprolactone acrylate, isobornyl acrylate (IBOA), or alkoxylated lauryl methacrylate.

Examples of suitable photoinitiators used to form one or more of the at least two different pre-polymer compositions include polymeric photoinitiators and/or oligomer photoinitiators, such as benzoin ethers, benzyl ketals, acetyl phenones, alkyl phenones, phosphine oxides, benzophenone compounds and thioxanthone compounds that include an amine synergist, or combinations thereof.

Examples of polishing pad materials formed of the pre-polymer compositions described above typically include at least one of oligomeric and, or, polymeric segments, compounds, or materials selected from the group consisting of: polyam ides, polycarbonates, polyesters, polyether ketones, polyethers, polyoxymethylenes, polyether sulfone, polyetherim ides, polyim ides, polyolefins, polysiloxanes, polysulfones, polyphenylenes, polyphenylene sulfides, polyurethanes, polystyrene, polyacrylonitriles, polyacrylates, polymethylmethacrylates, polyurethane acrylates, polyester acrylates, polyether acrylates, epoxy acrylates, polycarbonates, polyesters, melamines, polysulfones, polyvinyl materials, acrylonitrile butadiene styrene (ABS), halogenated polymers, block copolymers, and random copolymers thereof, and combinations thereof.

The sacrificial material composition(s), which may be used to form the pore-features 314, described above, include water-soluble material, such as, glycols (e.g., polyethylene glycols), glycol-ethers, and amines. Examples of suitable sacrificial material precursors which may be used to form the pore forming features described herein include ethylene glycol, butanediol, dimer diol, propylene glycol-(1,2) and propylene glycol-(1,3), octane-1,8-diol, neopentyl glycol, cyclohexane dimethanol (1,4-bis-hydroxymethylcyclohexane), 2-methyl-1,3-propane diol, glycerine, trimethylolpropane, hexanediol-(1,6), hexanetriol-(1,2,6) butane triol-(1,2,4), trimethylolethane, pentaerythritol, quinitol, mannitol and sorbitol, methylglycoside, also diethylene glycol, triethylene glycol, tetraethylene glycol, polyethylene glycols, dibutylene glycol, polybutylene glycols, ethylene glycol, ethylene glycol monobutyl ether (EGMBE), diethylene glycol monoethyl ether, ethanolamine, diethanolamine (DEA), triethanolamine (TEA), and combinations thereof.

In some embodiments, the sacrificial material precursor comprises a water soluble polymer, such as 1-vinyl-2-pyrrolidone, vinylimidazole, polyethylene glycol diacrylate, acrylic acid, sodium styrenesulfonate, Hitenol BC10®, Maxemul 6106®, hydroxyethyl acrylate and [2-(methacryloyloxy)ethyltrimethylammonium chloride, 3-allyloxy-2-hydroxy-1-propanesulfonic acid sodium, sodium 4-vinylbenzenesulfonate, [2-(methacryloyloxy)ethyl]dimethyl-(3-sulfopropyl)ammonium hydroxide, 2-acrylamido-2-methyl-1-propanesulfonic acid, vinylphosphonic acid, allyltriphenylphosphonium chloride, (vinylbenzyl)trimethylammonium chloride, allyltriphenylphosphonium chloride, (vinylbenzyl)trimethylammonium chloride, E-SPERSE RS-1618, E-SPERSE RS-1596, methoxy polyethylene glycol monoacrylate, methoxy polyethylene glycol diacrylate, methoxy polyethylene glycol triacrylate, or combinations thereof.

Additive Manufacturing System and Process Examples

Figure 7A:
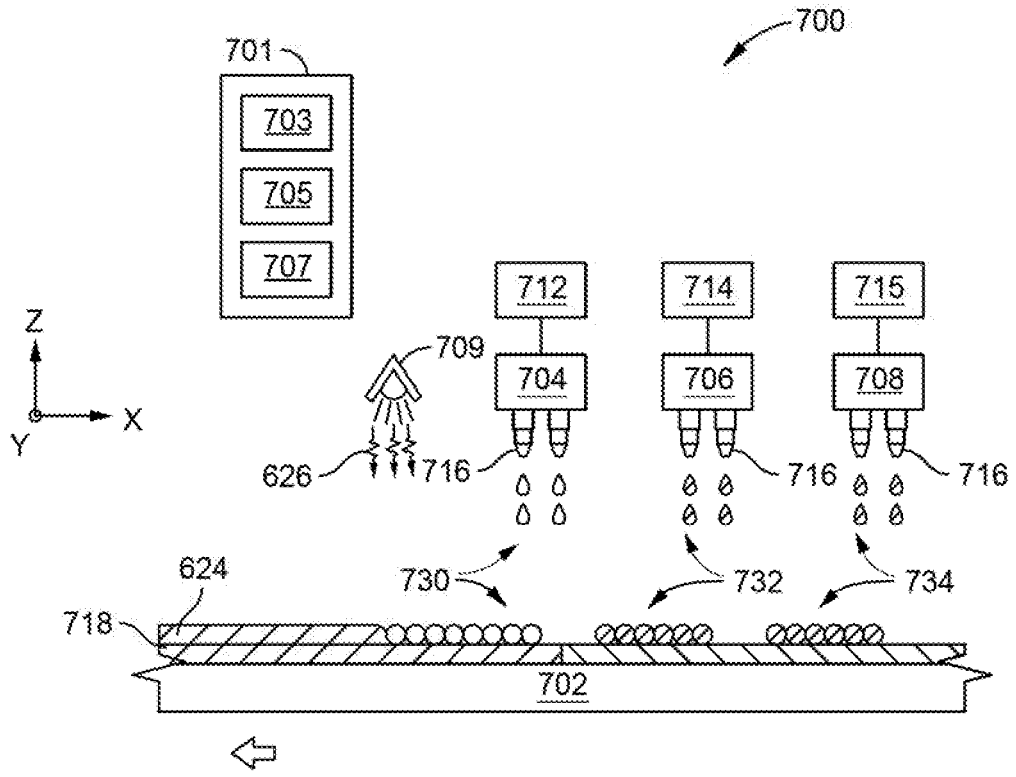
FIG. 7A is a schematic side view of an additive manufacturing system, according to one embodiment, which may be used to form the polishing pads described herein.

FIG. 7A is a schematic sectional view of an additive manufacturing system 700, according to one embodiment, which may be used to form the polishing pads described herein. Here, the additive manufacturing system 700 features a movable manufacturing support 702, one or more pre-polymer composition dispense heads, e.g, the first dispense head 704 and the second dispense head 706, and one or more sacrificial material dispense heads, e.g., the third dispense head 708, disposed above the manufacturing support 702, and a curing source 709. In some embodiments, the dispense heads 704, 706, 708 move independently of one another and independently of the manufacturing support 702 during the polishing pad manufacturing process. Here, the first and second dispense heads 704, 706 are fluidly coupled to corresponding pre-polymer composition sources 712 and 714 which are used to form the polishing materials described herein, including different material domains, and/or different material micro-domains thereof. The third dispense head 708 is coupled to a sacrificial material source 715 which is used to form the pore-features 314. In some embodiments, the additive manufacturing system 700 includes as many dispense heads as desired to each dispense a different pre-polymer composition or sacrificial material precursor compositions. In some embodiments, the additive manufacturing system 700 comprises pluralities of dispense heads where two or more dispense heads are configured to dispense the same pre-polymer compositions or sacrificial material precursor compositions.

Here, each of dispense heads 704, 706, 708 features an array of droplet ejecting nozzles 716 configured to eject droplets 730, 732, 734 of the respective pre-polymer compositions 712, 714 and sacrificial material composition 715 delivered to the dispense head reservoirs. Here, the droplets 730, 732, 734 are ejected towards the manufacturing support and thus onto the manufacturing support 702 or onto a previously formed print layer 718 disposed on the manufacturing support 702. Typically, each of dispense heads 704, 706, 708 is configured to fire (control the ejection of) droplets 730, 732, 734 from each of the nozzles 716 in a respective geometric array or pattern independently of the firing other nozzles 716 thereof. Herein, the nozzles 716 are independently fired according to a droplet dispense pattern for a print layer to be formed, such as the print layer 724, as the dispense heads 704, 706 move relative to the manufacturing support 702. Once dispensed, the droplets 730 of the pre-polymer composition and/or the droplets of the sacrificial material composition 714 are at least partially cured by exposure to electromagnetic radiation, e.g., UV radiation 726, provided by an electromagnetic radiation source, such as a UV radiation source 709, to form a print layer, such as the partially formed print layer 724.

Figure 7B:
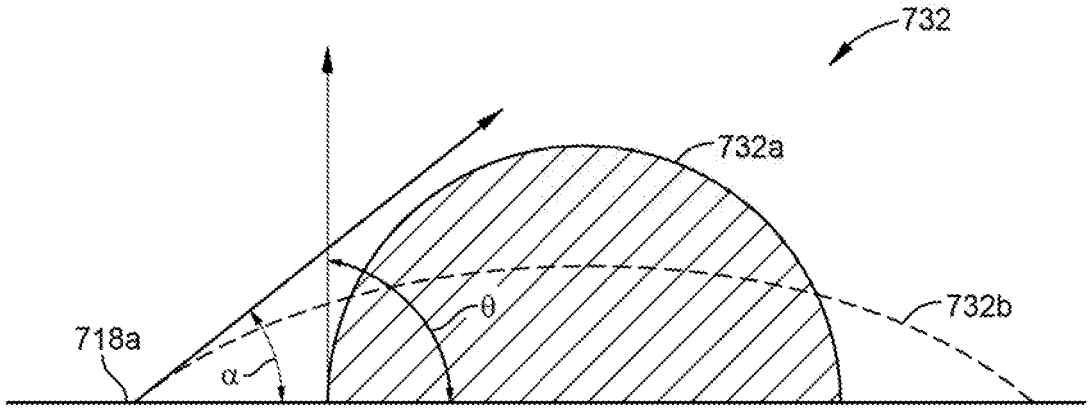
FIG. 7B is a close-up cross-sectional view schematically illustrating a droplet disposed on a surface of a previously formed print layer, according to one embodiment.

In some embodiments, dispensed droplets of the pre-polymer compositions, such as the dispensed droplets 730 of the first pre-polymer composition, are exposed to electromagnetic radiation to physically fix the droplet before it spreads to an equilibrium size such as set forth in the description of FIG. 7B. Typically, the dispensed droplets are exposed to electromagnetic radiation to at least partially cure the pre-polymer compositions thereof within 1 second or less of the droplet contacting a surface, such as the surface of the manufacturing support 702 or of a previously formed print layer 718 disposed on the manufacturing support 702.

FIG. 7B is a close up cross-sectional view schematically illustrating a droplet 733*a* disposed on a surface 719 of a previously formed layer, such as the previously formed layer 718 described in FIG. 7A, according to some embodiments. In a typically additive manufacturing process, a droplet of pre-polymer composition, such as the droplet 733*a* will spread and reach an equilibrium contact angle $\alpha$ with the surface 719 of a previously formed layer within about one second from the moment in time that the droplet 733*a* contacts the surface 719. The equilibrium contact angle $\alpha$ is a function of at least the material properties of the pre-polymer composition and the energy at the surface 719 (surface energy) of the previously formed layer, e.g., previously formed layer 718. In some embodiments, it is desirable to at least the partially cure the dispensed droplet before it reaches an equilibrium size in order to fix the droplets contact angle with the surface 719 of the previously formed layer. In those embodiments, the fixed droplet's 733*b* contact angle $\theta$ is greater than the equilibrium contact angle $\alpha$ of the droplet 733*a* of the same pre-polymer composition allowed to spread to its equilibrium size.

Herein, at least partially curing a dispensed droplet causes the at least partial polymerization, e.g., cross-linking of the pre-polymer composition(s) within the droplets and with adjacently disposed droplets of the same or different pre-polymer composition to form a continuous polymer phase. In some embodiments, the pre-polymer compositions are dispensed and at least partially cured to form a well about a desired pore before a sacrificial material composition is dispensed thereinto.

Here, the additive manufacturing system 700 further includes a system controller 701 to direct the operation thereof. The system controller 701 includes a programmable central processing unit (CPU 703) which is operable with a memory 705 (e.g., non-volatile memory) and support circuits 707. The support circuits 707 are conventionally coupled to the CPU 703 and comprise cache, clock circuits, input/output subsystems, power supplies, and the like, and combinations thereof coupled to the various components of the additive manufacturing system 700, to facilitate control thereof. The CPU 703 is one of any form of general purpose computer processor used in an industrial setting, such as a programmable logic controller (PLC), for controlling various components and sub-processors of the additive manufacturing system 700. The memory 705, coupled to the CPU 703, is non-transitory and is typically one or more of readily available memories such as random access memory (RAM), read only memory (ROM), floppy disk drive, hard disk, or any other form of digital storage, local or remote.

Typically, the memory 705 is in the form of a computer-readable storage media containing instructions (e.g., non-volatile memory), which when executed by the CPU 703, facilitates the operation of the manufacturing system 700. The instructions in the memory 705 are in the form of a program product such as a program that implements the methods of the present disclosure.

The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure. In some embodiments, the methods set forth herein, or portions thereof, are performed by one or more application specific integrated circuits (ASICs), field-programmable gate arrays (FPGAs), or other types of hardware implementations. In some other embodiments, the polishing pad manufacturing methods set forth herein are performed by a combination of software routines, ASIC(s), FPGAs and, or, other types of hardware implementations.

Here, the system controller 710 directs the motion of the manufacturing support 702, the motion of the dispense heads 704 and 706, the firing of the nozzles 716 to eject droplets of pre-polymer compositions therefrom, and the degree and timing of the curing of the dispensed droplets provided by the UV radiation source 708. In some embodiments, the instructions used by the system controller to direct the operation of the manufacturing system 700 include droplet dispense patterns for each of the print layers to be formed. In some embodiments, the droplet dispense patterns are collectively stored in the memory 725 as CAD-compatible digital printing instructions. An example of print instructions which may be used by the additive manufacturing system 700 to manufacture the polishing pad 300 is provided in FIGS. 8A-8B.

Figure 8A:
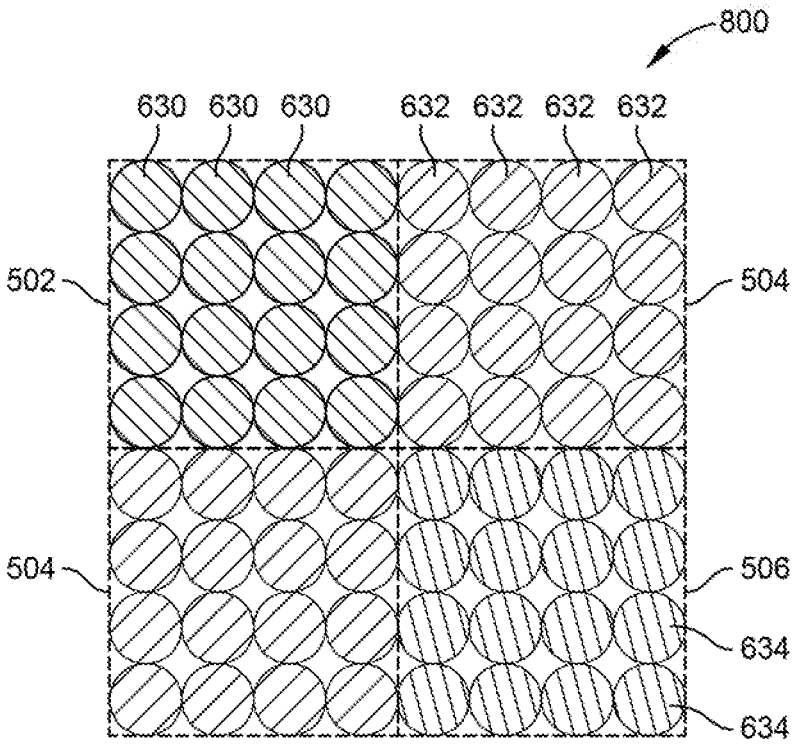
FIGS. 8A and 8B schematically illustrate droplet dispensing instructions which may be used by an additive manufacturing system to form a print layer of a polishing pad according to one or more embodiments described herein.
Figure 8B:
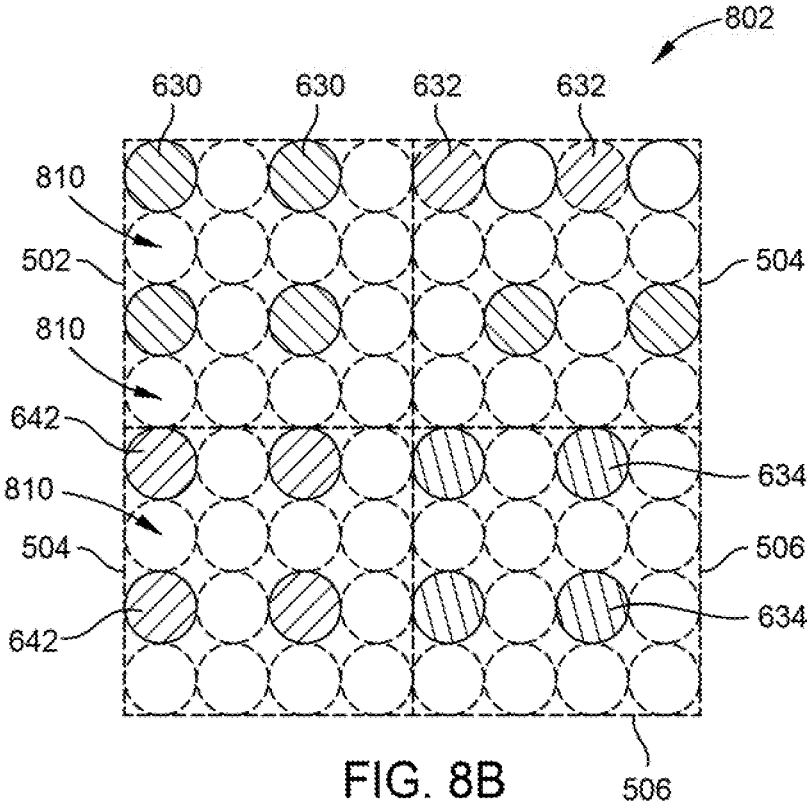

FIGS. 8A and 8B schematically represent portions of CAD compatible print instructions which may be used by the additive manufacturing system 700 to practice the methods set forth herein, according to some embodiments. Here, the print instructions 800 or 802 are used to control the placement of droplets 730, 732 of the pre-polymer compositions which are used to form respective material micro-domains 502, 504 and the droplets 734 of a sacrificial material precursor which are used to form the pore-features 506. Typically, the placement of the droplets 730, 732, and 734 are controlled by selectively firing one or more of the nozzles of a respective dispense head array of nozzles as the dispense heads of an additive manufacturing system move relative to a manufacturing support. FIG. 8B schematically represents a CAD compatible print instruction where less than all of the nozzles are fired as the dispense heads move relative to the manufacturing support and the space therebetween is shown in phantom as omitted droplets 810.

Typically, the combined volume of the droplets dispensed in a print layer, or a portion of a print layer, determines an average thickness thereof. Thus, the ability to selectively fire less than all of the nozzles within a dispense head array of nozzles allows for fine control over the Z-resolution (average thickness) of a print layer. For example, the print instructions 800 and 802 in FIGS. 8A and 8B may each be used to form one or more respective print layers of a polishing pad on the same additive manufacturing system. If the dispensed droplets are of the same size the combined volume of droplets dispensed using print instructions 802 will be less than the combined volume of droplets dispensed using print instructions 800 and thus will form a thinner print layer. In some embodiments, such as embodiments where less than all of the nozzles are fired as the dispense heads move relative to the manufacturing support, the droplets are allowed to spread to facilitate polymerization or copolymerization with other droplets dispensed proximate thereto and thus ensure substantial coverage of the previously formed print layer.

Figure 9A:
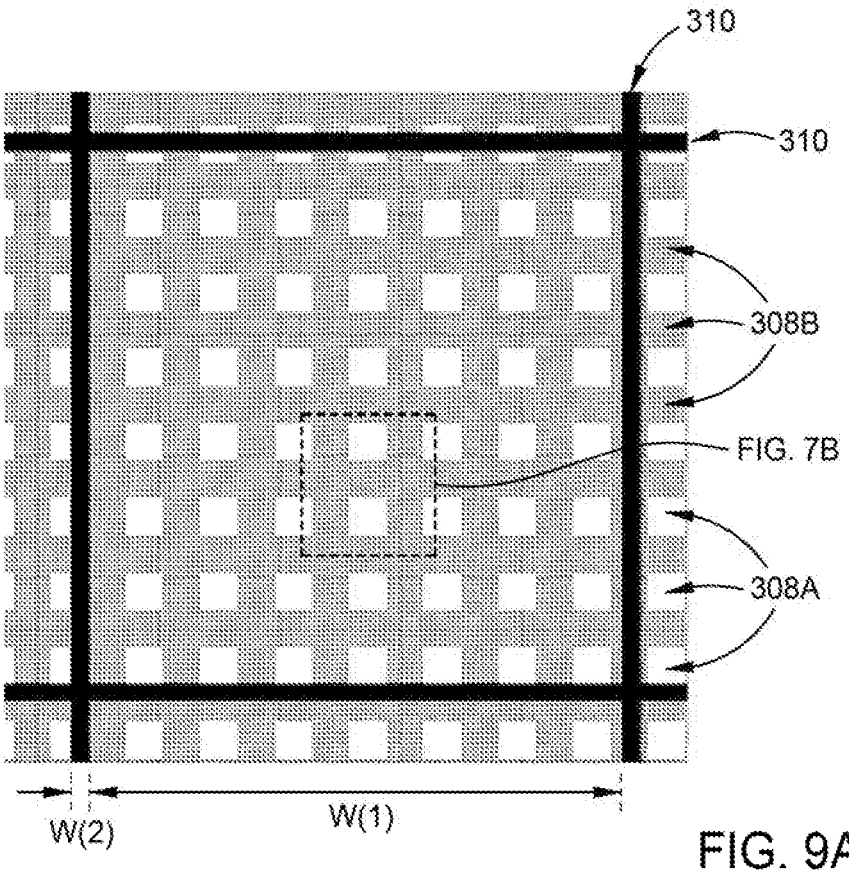
FIG. 9A shows a portion of CAD compatible print instructions, according to one embodiment, which may be used to form the polishing pad of FIG. 3A.
Figure 9B:
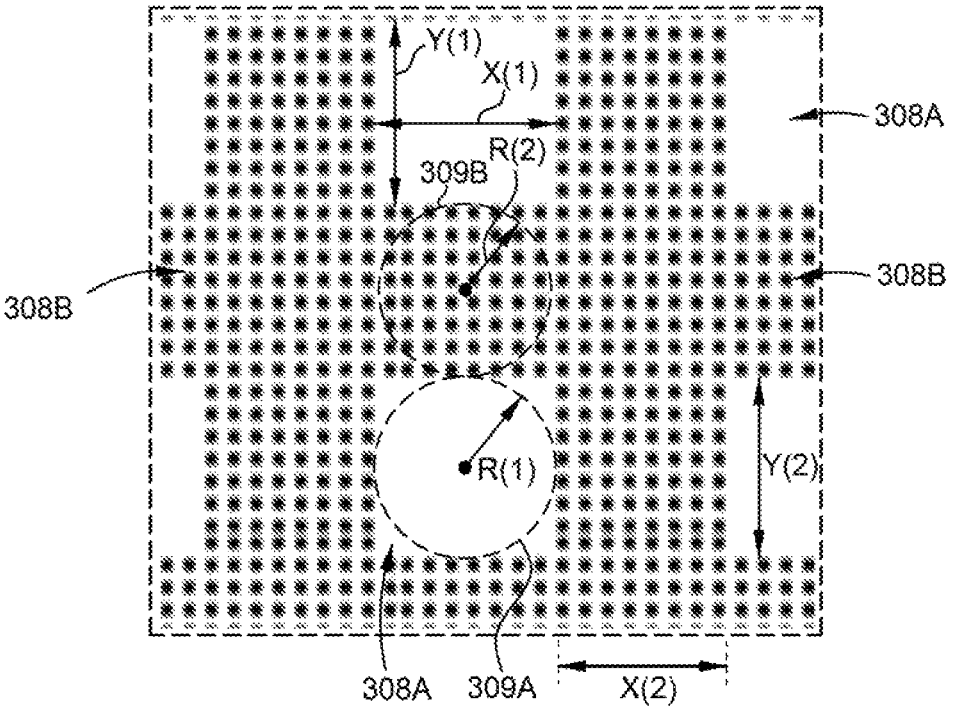
FIG. 9B is a close up view of a portion of FIG. 9A.

FIG. 9A shows a portion of CAD compatible print instructions 900, which may be used by the additive manufacturing system 700 to form an embodiment of the polishing pad 300 schematically represented in FIGS. 3A-3D. FIG. 9B is a close-up view of a portion of FIG. 9A. Here, the print instruction 900 is used to form a print layer comprising a portion of the polishing elements 304 having pore-features 314 formed therein. Typically, droplets of the pre-polymer composition(s) used to form the polymer material 312 are dispensed according to pixels forming the white regions and droplets of the sacrificial material composition(s) are dispensed within the black pixels of the second pore-feature density regions 308B. In this print layer, no droplets will be dispensed in the black regions between the polishing elements 304 (outside of the second pore-feature density regions 308B) which define the individual channels 310 disposed between the polishing elements 304.

Figure 10:
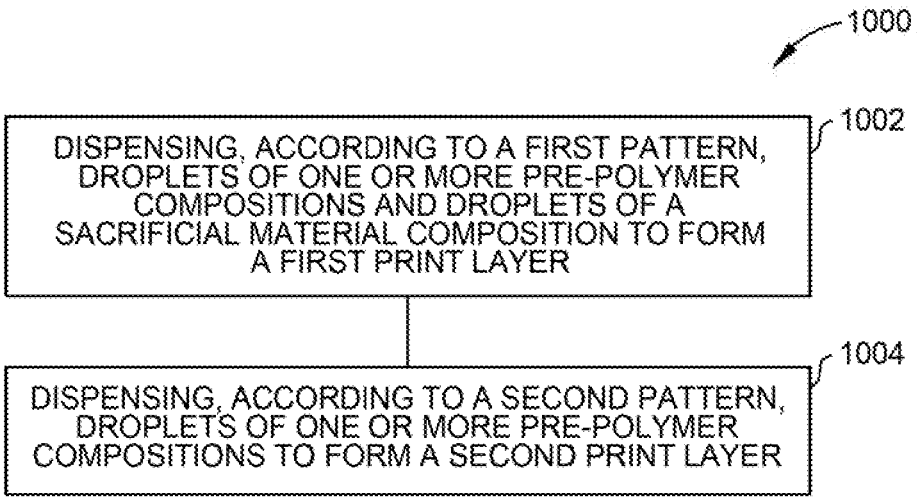
FIG. 10 is a flow diagram setting forth a method, according to one embodiment, of forming a polishing pad using an additive manufacturing system.

FIG. 10 is a flow diagram setting forth a method 1000 of forming a polishing pad using an additive manufacturing system, according to one embodiment. The method 1000 may be used in combination with one or more of the systems, system operations, and formulation and material examples described herein, such as the additive manufacturing system 700 of FIG. 7A, the fixed droplets of FIG. 7B, the print instructions of FIGS. 8A-8B, and the formulation and material examples described above. Further, embodiments of the method 1000 may be used to form any one or combination of embodiments of the polishing pads shown and described herein.

Here, the method 1000 is used to form a polishing layer of the polishing pad. The polishing layer features a plurality of first regions having a first pore-feature density and a plurality of second regions having a second pore-feature density. The plurality of first regions are distributed in a pattern across an X-Y plane parallel to a polishing surface of the polishing pad and are disposed in a side-by-side arrangement with the plurality of second regions. In this embodiment, the second pore-feature density is about 2% or more and the first pore-feature density is about ½ or less of the second pore-feature density.

At activity 1002, the method 1000 includes, dispensing, according to a first pattern, droplets of one or more pre-polymer compositions and droplets of a sacrificial material composition onto a surface of a previously formed print layer. Typically, activity 1002 further includes exposing the dispensed droplets to electromagnetic radiation to at least partially polymerize the one or more pre-polymer compositions and form a first print layer. Here, the droplets of the one or more pre-polymer compositions and the droplets of sacrificial-material composition are dispensed according to the first pattern to form a plurality of pore-features in the second regions and a height of the pore-features corresponds to a thickness of the first print layer. In some embodiments, activity 1002 of the method 1000 includes sequentially forming a plurality of first print layers and the height of the pore-features corresponds to a thickness of the plurality of adjoining first print layers.

At activity 1004, the method 1000 includes dispensing droplets of the one or more pre-polymer compositions onto a surface of the one or more first print layers formed in activity 1002 and exposing the dispensed droplets to electromagnetic radiation to form a second print layer. Typically, activity 1004 further includes exposing the dispensed droplets to electromagnetic radiation to at least partially polymerize the one or more pre-polymer compositions and form a second print layer. Here, the droplets of the one or more pre-polymer compositions are dispensed according to the second pattern to form a layer of polymer material over the pore-features formed in activity 1002. Individual ones of the plurality of pore-features are spaced apart in a Z direction by a thickness of the second print layer. In some embodiments, the activity 1004 includes sequentially forming a plurality of second print layers and the pore-features are spaced apart in the Z direction a thickness of the plurality of adjoining second print layers.

Typically, the method 1000 further includes sequential repetitions of activities 1002 and 1004 to form a plurality of first and second print layers stacked in a Z-direction, i.e., a direction orthogonal to the surface of the manufacturing support or a previously formed print layer disposed thereon.

In some embodiments, the droplets of the one or more pre-polymer compositions includes a plurality of droplets of a first pre-polymer composition and a plurality of droplets of a second pre-polymer composition. Here, the first regions are formed from the droplets of the first pre-polymer composition and the second regions are formed from the droplets of the second pre-polymer composition. The different pre-polymer compositions are used to form corresponding different first and second material domains and/or material micro-domains where the first material domains, and/or material micro-domains have a first storage modulus and the second material domains and/or material micro-domains have a second storage modules that is different from the first storage modules.

Figure 11:
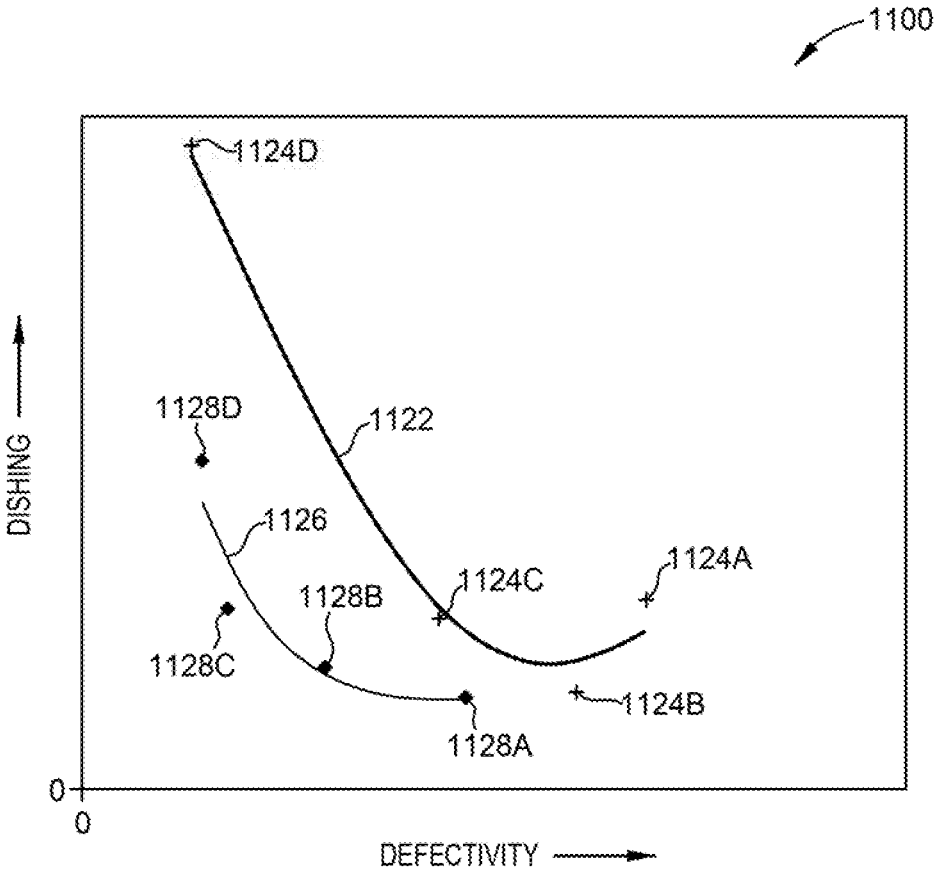
FIG. 11 is a graph comparing planarity-defectivity curves between polishing pads formed to have a uniform porosity and polishing pads formed according to embodiments described herein.

Desirably, the polishing pads formed according to the embodiments herein provide both superior planarization and surface finishing performance when compared to conventional polishing pads and polishing pads formed using an additive manufacturing process having uniform pore distribution, thus shifting the planarity-defectivity curve such as shown in FIG. 11.

FIG. 11 is a graph 1100 illustrating a planarity-defective curve 1122 for polishing pads 1124A-D of various hardness and porosity where the porosity is uniformly distributed in the polishing pad material thereof and a planarity-defectivity curve 1126 for polishing pads 1128A-D formed to have spatially arranged regions of different pore-feature densities according to the embodiments set forth herein. As shown in FIG. 11, the planarity-defectivity curve 1126 for the polishing pads provided herein is beneficially shifted towards an ideal null dishing and a null defectivity polishing result when compared to the planarity-defectivity curve 1122 for the polishing pads 1124A-D.

Table 2 shows hardness and pore-density % values for the various polishing pads 1124A-D. Here, the polishing pads 1124A-D which form the curve 1122 have uniform porosity and generally homogenous material composition across the polishing surface of the polishing pad.

TABLE 2

| Polishing Pad | Hardness (shore D) | Pore Density (%) |
|---|---|---|
| 1124A | 53 | 30 |
| 1124B | 66 | 66 |
| 1124C | 54 | 21 |
| 1124D | 27 | 33 |

Table 3 shows hardness and pore density (%) values for the polishing pads 1128A-D formed according to embodiments herein. Here, the polishing pads 1128A-D are formed of a plurality of polishing elements arranged to form corresponding segments of a plurality of spiral patterns, such as the plurality of spiral patterns shown in FIG. 6D. Polishing pad 1128A is formed to have a uniform distribution of pore-features across the polishing surface. Polishing pads 1128B-C are formed to have relatively high pore-feature density regions arranged in a continuous matrix to form an X-Y grid (when viewed from above), such as the X-Y grid of relativity high pore-feature density regions 308B of FIG. 9A, and a plurality of spaced apart low pore-feature density regions 308A interspersed within the X-Y grid. Polishing pads 1128A-C further include spatially arranged micro-domains of relatively hard and relatively soft polishing materials such as the spatially arranged material micro-domains 502 and 504 described in FIGS. 5A-5D. For polishing pads 1128A-C, the spatially arranged material micro-domains are generally arranged in a checkerboard pattern (when viewed from top down) with each of the individual material micro-domains having a dimension of about 160 μm by about 160 μm, although some of the surface area of the individual material micro-domains in the relatively high pore-feature density regions may be reduced by pore-features formed therein. The polishing material used to form the solid regions of polishing pad 1128D is generally homogeneous across the polishing surface thereof.

TABLE 3

| Polishing Pad | Hardness (shore D) | Pore-Feature Density (%) | Pore-Feature Size (X-Y) | Pore-Feature Separation (X-Y) |
|---|---|---|---|---|
| 1128A | 22 | 25 | 320 μm × 320 μm | 320 μm × 320 μm |
| 1128B | 37 | 8.3 | 80 μm × 80 μm | 240 μm × 160 μm |
| 1128C | 30 | 25 | 80 μm × 80 μm | 80 μm × 80 μm |
| 1128D | 8 | 16 | 80 μm × 80 μm | 120 μm × 120 μm |

While the foregoing is directed to embodiments of the present disclosure, other and further embodiments of the disclosure may be devised without departing from the basic scope thereof, and the scope thereof is determined by the claims that follow.

The invention claimed is:

1. A polishing pad having a polishing surface that is configured to polish a surface of a substrate, comprising:

a polishing layer, wherein at least a portion of the polishing layer comprises a continuous phase of polishing material comprising:

a plurality of first regions having a first pore-feature density; and a plurality of second regions having a second pore-feature density that is different from the first pore-feature density, wherein:

the plurality of first regions are distributed in a pattern in an X-Y plane of the polishing pad in a coplanar side-by-side arrangement with the plurality of second regions and the plurality of first regions and the plurality of second regions extend in a Z-direction orthogonal to the X-Y plane, the second regions are disposed in a staggered arrangement in the Z-direction, individual portions or ones of the plurality of first regions are interposed between individual portions or ones of the plurality of second regions, the first and second pore-feature densities comprise a cumulative area of a plurality of pore-features as a percentage of total area of the respective first and second regions in the X-Y plane, the plurality of pore-features comprises openings defined in a surface of the polishing layer, voids that are formed in the polishing material below the surface, pore-forming features comprising a water-soluble-sacrificial material, or combinations thereof, the X-Y plane is parallel to the polishing surface of the polishing pad, and the individual portions or ones of the plurality of first regions interposed between the individual portions or ones of the plurality of second regions comprise at least a continuous area defined by a first circle in the X-Y plane having a first radius equal to or greater than about 100 μm.

2. The polishing pad of claim 1, wherein the second pore-feature density is about 2% or more and the first pore-feature density is about ½ or less of the second pore-feature density.

3. The polishing pad of claim 1, wherein the plurality of second regions form a continuous matrix and individual ones of the plurality of first regions are spaced apart from one another by at least portions of the continuous matrix of second regions disposed therebetween.

4. The polishing pad of claim 1, wherein individual pore-features in the plurality of second regions having a height in the Z-direction that about 50 μm or less and a diameter in the X-Y plane that is between about 50 μm and about 250 μm, wherein the Z-direction is orthogonal to the X-Y plane.

5. The polishing pad of claim 4, wherein the height of the individual pore-features is about ½ or less than the diameter.

6. The polishing pad of claim 1, wherein the second pore-feature density is about 2% or more, the first pore-feature density is about ½ or less than the second pore-feature density, the plurality of first regions are formed of corresponding first material domains having a first storage modulus, the plurality of second regions are formed of corresponding second material domains having a second storage modulus, and the second storage modulus is about ½ or less than the first storage modulus.

7. The polishing pad of claim 1, wherein the plurality of first regions are formed of corresponding first material domains having a first storage modulus and the plurality of second regions are formed of corresponding second material domains having a second storage modulus that is different from the first storage modulus.

8. The polishing pad of claim 1, further comprising a foundation layer having the polishing layer disposed thereon, wherein the foundation layer is formed of a different pre-polymer composition or a different ratio of at least two pre-polymer compositions then are used to form the polishing layer, and wherein the foundation layer is integrally formed with the polishing layer to provide a continuous phase of polymer material across interfacial boundary regions therebetween.

9. The polishing pad of claim 8, wherein the polishing layer comprises a plurality of polishing elements extend upwardly from the foundation layer to form the polishing surface, wherein individual ones of the plurality of polishing elements are spaced apart from one another in the X-Y plane to define a plurality of channels therebetween, and wherein the each of the polishing elements comprises the plurality of first regions having the first pore-feature density and the plurality of second regions having the second pore-feature density.

10. A polishing pad, comprising:

a foundation layer; and a polishing layer disposed on the foundation layer and integrally formed therewith to comprise a continuous phase of polymer material across interfacial boundary regions therebetween, wherein the polishing layer comprises:

a plurality of first regions having a first pore-feature density; and a plurality of second regions comprising a plurality of pore-features to provide a second pore-feature density of about 2% or more, wherein:

at least portions of the first regions are spaced apart from one another in an X-Y plane of the polishing pad by and coplanar with at least portions of the second regions and the plurality of first regions and the plurality of second regions extend in a Z-direction orthogonal to the X-Y plane, the second regions are disposed in a staggered arrangement in the Z-direction, the first and second pore-feature densities comprise a cumulative area of a plurality of pore-features as a percentage of total area of the respective first and second regions in the X-Y plane, the plurality of pore-features comprises openings defined in a surface of the polishing layer, voids that are formed in the polishing material below the surface, pore-forming features comprising a water-soluble-sacrificial material, or combinations thereof, the first pore-feature density is about ½ or less of the second pore-feature density, individual ones of the plurality of pore-features in the plurality of second regions have a height in a Z direction that is about ½ or less than a diameter of the pore measured in the X-Y plane, the X-Y plane is parallel to the polishing surface of the polishing pad and the Z direction is orthogonal to the X-Y plane, and the plurality of first and second regions form a continuous phase of polymer material across the interfacial boundary regions therebetween.

11. The polishing pad of claim 10, wherein the plurality of first regions and the plurality of second regions are formed by sequential repetitions of:

(a) dispensing droplets of one or more pre-polymer compositions and droplets of a sacrificial-material composition onto a surface of a previously formed print layer and exposing the dispensed droplets to electromagnetic radiation to form a first print layer;

(b) optionally repeating (a) to form a plurality of adjoining first print layers, wherein the droplets of sacrificial-material composition are dispensed according to a first pattern to form a plurality of pore-forming features in the second regions, wherein the height of individual ones of the plurality of pore-forming features is determined by a thickness of each of the first print layers and a number of repetitions of (a);

(c) dispensing droplets of the one or more pre-polymer compositions onto a surface of the one or more first print layers formed in (a) and/or (b) and exposing the dispensed droplets to electromagnetic radiation to form a second print layer; and (d) optionally repeating (c) to form a plurality of adjoining second print layers, wherein the droplets of the one or more pre-polymer compositions are dispensed according to a second pattern to form a layer of polymer material, wherein individual ones of the plurality of pore-forming features are spaced apart in the Z direction by the layer of polymer material, and wherein the spacing of the individual pore-forming features in the Z direction is determined by a thickness of each of the second print layers and the number of repetitions of (c).

12. The polishing pad of claim 11, wherein the plurality of first regions are formed of corresponding first material domains having a first storage modulus and the plurality of second regions are formed of corresponding second material domains having a second storage modulus that is different from the first storage modulus.

13. The polishing pad of claim 12, wherein the droplets of the one or more pre-polymer compositions comprises a plurality of droplets of a first pre-polymer composition and a plurality of droplets of a second pre-polymer composition, and wherein the first material domains are formed from the droplets of the first pre-polymer composition and the second material domains are formed from the droplets of the second pre-polymer composition.

14. The polishing pad of claim 10, wherein the at least portions of the plurality of first regions interposed between the at least portions of the plurality of second regions comprise at least a continuous area defined by a first circle in the X-Y plane having a first radius equal to or greater than about 100 μm.

15. The polishing pad of claim 14, wherein the polishing layer comprises a plurality of polishing elements that extend upwardly from the foundation layer to form a polishing surface, wherein individual ones of the plurality of polishing elements are spaced apart from one another in the X-Y plane to define a plurality of channels therebetween, and wherein the each of the polishing elements comprises the plurality of first regions and the plurality of second regions.

* * * * *